US007105287B2

(12) United States Patent
Kondo et al.

(10) Patent No.: US 7,105,287 B2
(45) **Date of Patent: *Sep. 12, 2006**

(54) SILVER HALIDE EMULSION AND SILVER HALIDE PHOTOGRAPHIC MATERIAL

(75) Inventors: Toshiya Kondo, Hino (JP); Katsuya Yabuuchi, Musashimurayama (JP); Rieko Ren, Kunitachi (JP)

(73) Assignee: Konica Minolta Photo Imaging, Inc., Tokyo (JP)

( * ) Notice: Subject to any disclaimer, the term of this patent is extended or adjusted under 35 U.S.C. 154(b) by 138 days.

This patent is subject to a terminal disclaimer.

(21) Appl. No.: 11/058,075

(22) Filed: Feb. 15, 2005

(65) Prior Publication Data

US 2005/0191587 A1 Sep. 1, 2005

(30) Foreign Application Priority Data

Feb. 27, 2004 (JP) ..... 2004-053348

(51) Int. Cl.
*G03C 1/08* (2006.01)
*G03C 7/26* (2006.01)
*G03C 7/32* (2006.01)

(52) U.S. Cl. ..... 430/567; 430/502; 430/603; 430/604; 430/605

(58) Field of Classification Search ..... 430/502, 430/567, 603, 604, 605
See application file for complete search history.

(56) References Cited

U.S. PATENT DOCUMENTS

2005/0208436 A1* 9/2005 Kondo et al. ..... 430/567

* cited by examiner

*Primary Examiner*—Geraldine Letscher
(74) *Attorney, Agent, or Firm*—Lucas & Mercanti

(57) ABSTRACT

A silver halide emulsion is disclose, containing silver halide grains, in which at least 50% by number of the silver halide grains is accounted for by (1) cubic grains (2) having a chloride content of not less than 90 mol %, (3) an iodide content of from 0 to 2 mol % and (4) a bromide content of from 0.1 to 10 mol %, and (5) containing dislocation lines in the peripheral region and (6) having rounded corners.

9 Claims, No Drawings

SILVER HALIDE EMULSION AND SILVER HALIDE PHOTOGRAPHIC MATERIAL

FIELD OF THE INVENTION

The present invention relates to a silver halide photographic emulsion, a silver halide photographic material and an image forming method specifically when subjected to digital exposure at a relatively high intensity for a short time.

BACKGROUND OF THE INVENTION

The recent rapid directivity to digitization has led to increased opportunities of subjecting silver halide photographic materials to digital exposure. Along with such a trend, photographic color paper as a photographic material for color prints is desired with respect to suitability for exposure at a relatively high intensity for an extremely short time at the level of milli-seconds to nano-seconds and aptitude for scanning exposure.

There have been employed silver chloride emulsions or high chloride silver halide emulsions in color paper to achieve rapid processability. Further, it is commonly known that doping iridium compounds is effective to improve reciprocity law failure characteristics as a matter of properties of silver halide emulsions. There are disclosed high chloride silver halide emulsion grains having a high bromide region in the vicinity of the corners of the grains, as described in JP-A No. 64-26837 (hereinafter, the term JP-A refers to Japanese Patent Application Publication); high chloride silver halide emulsion grains in which a bromide-localized region is selectively doped with an iridium compound, thereby leading to superior latent image stability and reciprocity law failure characteristics, as described in JP-A No. 1-105940. There is also disclosed a method of forming a bromide-localized region by using silver bromide fine-grains doped with an iridium compound, as described in U.S. Pat. No. 5,627,020. However, neither of the foregoing methods was sufficient for improving latent image stability in the initial stage after exposure.

In digital exposure systems of the recent subject, it was proved that sufficient practical qualities were not achieved by only known techniques for improving latent image stability, in exposure suitability at a high intensity for an extremely short time. Techniques adaptable to such a digital exposure system include, for examples, chemical sensitization and spectral sensitization suitable for formation of a bromide-localized phase, as described in U.S. Pat. No. 5,691,119; and the use of a silver iodochloride emulsion, as described in European Patent Nos. 750,222 and 772,079.

However, it was proved in studies by the inventors of this application that the foregoing techniques for improving aptitude for digital exposure was not only insufficient for improving latent image stability but also resulted in marked deteriorated pressure resistance and pre-exposure storage stability of photographic materials. It is desired to immediately solve this matter.

JP-A No. 2001-188311 discloses a method for improving reciprocity law failure and coating solution stability, in which silver halide grains contain a bromide-rich or iodide-rich phase in the vicinity of the grain surface and introduction of such a rich phase is separated into two occasions, before and after addition of mercapto compounds. However, it was proved that using only this method was insufficient for improving storage stability of silver halide emulsions.

There were disclosed techniques for improving photographic performance such as sensitivity, fogging and reciprocity law failure by using silver iodochloride grains exhibiting iodide content decreasing from the grain surface in the direction of depth, as disclosed in JP-A No. 2002-174870, and high chloride silver halide grains having a maximum iodide content in the corners greater than that of the major faces, as disclosed in JP-A No. 2002-296718. However, there is further desired a technical improvement to achieve enhanced photographic performance and storage stability.

With regard to selenium sensitization, JP-A No. 5-66513 and U.S. Pat. No. 5,240,827 disclosed photographic elements comprising silver chloride grains containing a selenium compound on the grain surface, in which photographic performance, except for sensitivity was unclear and there was no description regarding gamma, a latent image and other performances required in photographic materials for print, so that it was difficult to provide a practical silver halide photographic material satisfying recently required performances. JP-A Nos. 5-313293, 9-5922 and 9-5924 disclosed silver halide photographic materials applying selenium or tellurium sensitization to silver chloride or high chloride silver bromochloride grains, in which improvement for performance such as latent image stability and coating solution stability were unknown and of which effects on sensitivity and gamma were insufficient to meet the recent demand for silver halide photographic material.

There were disclosed techniques for applying 8th group metal complexes containing an aqua ligand to silver halide grains, including a silver halide grain emulsion containing an iridium complex having halogen and aqua ligands and also having an iridium complex containing layer localized on the grain surface, as disclosed, for example, in JP-A No. 11-202440, and a silver halide emulsion containing high chloride silver halide grains occluding an iridium complex having an aqua ligand, as disclosed in JP-A No. 2001-356441. There were also disclosed techniques for applying 8th group metal complexes containing an organic ligand to silver halide grains, including a silver halide emulsion containing high chloride silver halide grains occluding a six-coordinate complex of metals other than iridium and an iridium complex containing a thiazole or substituted thiazole ligand, as disclosed in U.S. Pat. No. 6,107,018, and a silver halide emulsion containing high chloride silver halide grains occluding an iridium complex containing an aqua or thiazole ligand and an iridium complex containing a halogen ligand, as disclosed in JP-A No. 2002-162708. However, the foregoing techniques were insufficient to meet recent requirements for enhanced sensitivity, latent image stability and digital exposure suitability.

Further, there was also disclosed introduction of dislocation lines into silver halide grains, for example, JP-A No. 2001-255613 disclosed a silver halide tabular grain emulsion containing dislocation in the fringe portion of (111) major faces, JP-A No. 2003-15244 disclosed a silver halide tabular grain emulsion comprising (111) major faces having epitaxial junctions in the corner portion and containing dislocation lines in the epitaxial portion, JP-A No. 11-218866 disclosed a silver halide tabular grain emulsion containing dislocation lines in the fringe portion or in the vicinity of the corner, and JP-A Nos. 2000-241922 and 2001-133921 disclosed a silver halide emulsion comprising regular crystal grains containing dislocation lines. However any one of the foregoing disclosures concerns techniques of silver halide emulsion mainly comprised of silver iodobromide, intended for color negative photographic materials and there was no disclosure regarding introduction of dislocation lines into silver halide regular crystal grains mainly comprised of silver chloride.

SUMMARY OF THE INVENTION

Accordingly, it is an object of the present invention to provide a silver halide emulsion and a silver halide photographic material exhibiting enhanced sensitivity, superior latent image stability, coating solution stability and storage stability, whereby high quality prints can stably be obtained and superior image quality and print reproducibility are achieved even in digital exposure at high intensity for a short period and an image forming method by use thereof.

One aspect of the invention is directed to a silver halide emulsion comprising silver halide grains, wherein at least 50% by number of the silver halide grains is accounted for by grains meeting the following requirement (1) to (6):

(1) cubic grains (2) having a chloride content of not less than 90 mol %, (3) an iodide content of from 0 to 2 mol % and (4) a bromide content of from 0.1 to 10 mol %, and (5) containing dislocation lines in the peripheral region of the projection from the direction vertical to a (100) face of the grains and (6) having rounded corners.

In another aspect the invention is directed to a silver halide emulsion comprising silver halide grains, wherein at least 50% by number of the silver halide grains is accounted for by grains meeting the following requirement (7) to (12):

(7) cubic grains (8) having a chloride content of not less than 90 mol %, (9) an iodide content of from 0 to 2 mol % and

(10) a bromide content of from 0.1 to 10 mol %, and

(11) containing dislocation lines in the peripheral region of the projection from the direction vertical to a (100) face of the grains and

(12) having rounded corners of the projection from the direction vertical to a (100) face of the grains.

Further, in another aspect the invention is directed to a silver halide photographic material comprising on a support at least one image forming layer containing a silver halide emulsion as described above.

In cubic silver halide grains composed mainly of silver chloride, conventionally known methods of introducing bromide or iodide thereto, even in slight amounts, are easily accompanied by deterioration of photographic characteristics such as enhanced developability and high contrast as advantages of using high chloride silver halide grains, and introduction of iodide easily causes increased fogging, whereby it is limited to achieve enhanced sensitivity, improved latent image stability, coating solution stability and storage stability and enhancement of image quality and print reproducibility in digital exposure without vitiating photographic performance. Further, there have been known techniques of dislocation lines with respect to advantageous effects such as enhanced sensitivity or improved graininess of tabular silver halide grains mainly composed of silver iodobromide; however, introduction of dislocation lines was achieved by addition of a relatively large amount of an iodide and application of this technique to high chloride silver halide grains was accompanied by marked performance deterioration, which was not realistically advantageous.

The present invention has come into being as a result of extensive study of the foregoing problems. Thus, it is preferred to achieve introduction of dislocation lines into cubic silver halide grains by increasing a solution concentration at the time of introducing and growing dislocation lines in the process of grain growth or by using a bromide besides an iodide, specifically by the use of an iodide ion releasing agent and/or a bromide ion releasing agent. Specifically, it was found to be effective to achieve the foregoing performances that enhancement of the dislocation line density or control of sites of dislocation lines was feasible by controlling the releasing rate and the releasing amount through optimum selection of the kind of compounds, releasing environment and the amount to be used, even when a relatively small amount of a bromide or iodide was used, and that corners or edges of the high-chloride silver halide grains having dislocation lines are rounded.

There has been known the use of a group 8 metal complex containing an aqua ligand and/or organic ligand, resulting in superior performance in latent image stability and storage stability, specifically when uses in combination with silver halide grains. Selenium sensitization which has been predominantly applied to silver halide grains mainly composed of silver iodobromide was concerned about fogging or deteriorated storage stability for high chloride silver halide grains but it was proved that enhanced sensitivity was achieved without deterioration in storage stability or coating solution stability when applied to silver halide grains according to this invention.

DETAILED DESCRIPTION OF THE INVENTION

In one feature of the silver halide emulsion of the invention, cubic silver halide grains account for at least 50% by number of whole silver halide grains, preferably at least 70% and more preferably at least 90% by number.

The foregoing cubic silver halide grains refers to cubic grains having (100) faces as the major crystal surface. There may exist a face of an index of plane other than a (100) face on the outer surface of silver halide grains and the expression, silver halide grains having (100) faces as the major crystal surface means that the proportion of (100) faces is at least 70% (in other words, the (100) face accounts for at least 70% of the whole grain surface), preferably at least 80% and more preferably at least 90%.

The proportion of (100) faces of the individual silver halide grain can be determined in such a manner that the grain is subjected to oblique deposition of a metal (shadowing treatment) and, observed by SEM (Scanning Electron Microscope), and the observed image is further subjected to image processing. Specifically, the measurement is conducted according to the following procedure.

To take out silver halide grains from a silver halide emulsion used for measurement, gelatin used as a dispersing medium is usually degraded using a proteinase, followed by centrifugal separation to decant the supernatant and washing with distilled water. When silver halide grains exist in a coating layer containing gelatin as a main binder, gelatin is degraded by a proteinase to take out silver halide grains. In cases when a polymer other than gelatin is contained, such a polymer can be removed through solution in an appropriate organic solvent. A dye or a sensitizing dye adsorbed onto the grain surface can be removed using an aqueous alkali solution or alcohol to obtain a clean silver halide grain surface. Grains dispersed in water are coated on a conductive substrate and dried for use in measurement. It is preferred to allow grains to be arranged on the substrate without aggregating and it is also preferred to observe a sample obtained according to the foregoing procedure, using an optical microscope or an SEM. There may be used a dispersing aid to prevent aggregation of grains. Alternatively, after degradation by proteinase, a dispersion diluted with distilled water may be coated on the conductive substrate. There may be optionally employed a rotation coater or a vacuum freeze dryer to allow grains to arrange on the substrate without aggregation. Preferably, the conductive substrate employs a mirror-polished, low-resistant silicon single-crystal wafer exhibiting a resistance of 1.0 Ω/cm or less which has been sufficiently washed. There may be employed a smoothed polyethylene terephthalate base having thereon a conductive carbon deposited.

Onto silver halide grains dispersed on the substrate, metal is vapor-deposited from the direction at an angle of 45° to the substrate. There are generally used Cr, Pt and Pd as a metal to be deposited and platinum carbon is preferred in terms of graininess of the deposited film and linear propagation of deposition. An exceedingly thin metal deposit film makes it difficult to obtain-contrast difference necessary for discrimination of a (100) face from a non-(100) face in the SEM observation, while an excessively thick film results in increased measurement error. Thus, a thickness of approximately 20 nm is preferred. The SEM used for observation is preferably a high resolution type instrument to enhance measurement precision. Observation is typically conducted at an electron beam acceleration voltage of 1.8 kV whereby a contrast difference is easily obtained to discriminate upward oriented (100) face, external shape of the grains and the substrate in subsequent image processing. The grains were observed from right above without sample inclination.

An observation is images using Polaroid film or negative film and read via a computer for image processing, employing a scanner. Preferably, to minimize image deterioration in reading, the SEM and an image processing computer are connected to perform storage as an on-line digital image. From the read image, impulse noise is removed by a median filter through image processing software. Thereafter, binary coding is conducted at threshold values enabling image extraction of the upward oriented (100) faces and the grain outline and the respective grains are numbered to measure their areas. The thus measured (100) face area and area within the outline of a grain were inputted into a spreadsheet software based on the ASCII form to determine the proportion of (100) faces for the respective grains.

The grain size of silver halide grains relating to this invention is not specifically limited but is preferably from 0.1 to 2.0 μm, more preferably from 0.1 to 1.0 μm, and still more preferably 0.15 to 0.8 μm in terms of rapid processability, sensitivity and other photographic performance Monodisperse silver halide grains exhibiting a coefficient of variation in grain size of not more than 0.22 (more preferably not more than 0.15, and still more preferably not more than 0.1) are preferred in the invention. The coefficient of variation (hereinafter, also denoted as variation coefficient) in grain size is a factor representing the width of grain size distribution and defined as below:

$$\text{coefficient of variation}=S/R$$

wherein S is the standard deviation of grain size distribution and R is the average grain size. The grain size is the diameter of a circle having the same area as the projected area of a grain.

In the silver halide emulsion relating to this invention, silver halide grains having a chloride content of 90 mol % or more account for at least 50% by number of all of the grains, preferably at least 70%, and more preferably at least 90%. The silver halide grains preferably have an average chloride content of at least 93 mol % and more preferably at least 95 mol %.

In the silver halide emulsion relating to this invention, silver halide grains having an iodide content of from 0 to 2 mol % or more account for at least 50% by number of all of the grains, preferably at least 70%, and more preferably at least 90%. The silver halide grains preferably have an average iodide content of from 0.02 to 2 mol % and more preferably from 0.05 to 1 mol %.

In the silver halide emulsion relating to this. invention, silver halide grains having a bromide content of from 0.1 to 10 mol % or more account for at least 50% by number of all of the grains, preferably at least 70%, and more preferably at least 90%. The silver halide grains preferably have an average bromide content of from 1.5 to 10 mol % and more preferably from 2.0 to 10 mol %.

The silver halide grains relating to this invention preferably have at least one iodide-localized silver halide phase in the interior of the grains. In the invention, the interior of the grains refers to a silver halide phase, except for the grain surface. The iodide-localized silver halide phase (hereinafter, also denoted as iodide-localized phase) is a silver halide phase having at least two times the average iodide content of the grains, preferably at least three times the average iodide content, and more preferably at least 5 times the average iodide content. The iodide-localized phase is located in a portion external to 60% (preferably 70%, and more preferably 80%) of the grain volume within the grain. In other words, the iodi de-localized phase is located in an exterior region outside the interior region accounting for at least 60% of the total silver forming the grains. The iodide-localized phase is located in a portion external to preferably 70%, and more preferably 80% of the grain volume within the grain. In one preferred embodiment, the iodide-localized phase exists in the form of a layer in the interior of the grain (which is hereinafter also called iodide-localized layer) and the iodide-localized layer preferably composed of at least two layers, in which the main layer is introduced according to the conditions described above and at least one layer (hereinafter, called a sub-layer) having an iodide content less than the maximum iodide content is introduced closer to the grain surface than the main layer. Iodide contents of the main layer and sub-layer can be chosen in accordance with the objective. Preferably, the main layer has an iodide content as high as possible and the sub-layer has an iodide content lower than the main layer from the viewpoint of latent image stability. In another preferred embodiment, the iodide-localized phase, which exists in the vicinity of corners or edges of the grain can be used in combination with the foregoing iodide-localized phase.

A silver halide emulsion comprising silver halide grains having a high bromide portion within the grain is also preferred in this invention. The high bromide portion may be formed by an epitaxial junction or by forming a core/shell structure. Alternatively, there may exist regions partially differing in bromide composition without forming a complete layer. The bromide composition may be continuously varied or discontinuously varied, and silver halide grains having a bromide-localized phase in the vicinity of corners of the grain are preferred. The expression bromide-localized phase herein means a silver halide phase having a relatively high bromide content. Thus, the bromide-localized phase has a bromide content of at least two times the average bromide content of the grains, preferably at least three times and more preferably at least 5 times the average bromide content. The bromide-localized phase preferably contains a Group 8 metal compound, as described later. The Group 8 metal compound is preferably an iridium complex compound.

The bromide content and iodide content of silver halide grains can be determined in the EPMA method (Electron Probe Micro Analyzer method). Thus, silver halide grains are dispersed so as to not be in contact with each other to prepare a sample. The sample is irradiated with an electron beam, while cooling at a temperature of not more than 100° C. using liquid nitrogen, and the characteristic X-ray intensities of silver, bromine and iodine, radiated from a single silver halide grain are measured to determine iodide and bromide contents of the grain.

There can be used various iodine compounds to allow silver iodide to be contained in silver halide grains. Examples thereof include the use of an aqueous iodide salt solution, such as an aqueous potassium iodide solution, the use of a polyiodide compound, as described in S. Nakahara "Mukikagobutsu•Sakutai Jiten" (Dictionary of Inorganic Compound and Complex, page 944, published by Kodan-sha) and the use of fine iodide-containing silver halide grains or iodide ion-releasing agents, as disclosed in JP-A No. 2-68538. The use of an aqueous iodide salt solution, fine iodide-containing silver halide grains or iodide ion-releasing agents is preferred, the use of iodide ion-releasing agents is more preferred, and the use of iodide ion-releasing compounds described in JP-A No. 11-271912 is specifically preferred. The iodide content of silver halide grains and the iodide content of an iodide-localized phase can arbitrarily be controlled by adjusting the concentration or the quantity of an iodide containing solution.

There can also be used various bromide compounds to allow silver bromide to be contained in silver halide-grains. Examples thereof include the use of an aqueous bromide salt solution, such as an aqueous potassium bromide solution, the use of bromide-containing silver halide fine-grains or bromide ion-releasing agents, as disclosed in JP-A No. 2-68538. Of these, use of an aqueous bromide salt solution, fine bromide-containing silver halide grains or bromide ion-releasing agents is preferred, the use of bromide ion-releasing agents is more preferred, and the use of bromide ion-releasing compounds described in JP-A No. 11-271912 is specifically preferred. The bromide content of silver halide grains and the bromide content of a bromide-localized phase can arbitrarily be controlled by adjusting the concentration or the quantity of an bromide containing solution.

When allowing silver iodide and/or silver bromide to be contained in a silver halide phase by supplying silver halide fine-grains, the silver halide fine-grains preferably have an average grain size of not more than 0.05 μm, more preferably from 0.001 to 0.03 μm, and still more preferably from 0.001 to 0.02 μm. The silver halide fine-grains are prepared preferably using a low molecular weight gelatin having an average molecular weight of 40,000 or less, more preferably from 5,000 to 25,000, and still more preferably from 5,000 to 15,000. The silver halide fine-grains are prepared preferably at a temperature of not more than 40° C., more preferably not more than 30° C., and still more preferably from 5 to 20° C. The silver halide fine-grains can be prepared by commonly known methods and apparatuses and the use of a continuous nucleation apparatus described in JP-A No. 2000-112049 is specifically preferred.

In the silver halide grain emulsion relating to this invention, grains containing dislocation lines in the peripheral region of the grains account for at least 50% by number of all the silver halide grains, preferably at least 70% and more preferably at least 80% by number.

In the silver halide grain emulsion relating to this invention, at least 50% by number of all of silver halide grains is preferably accounted for by grains each containing at least 5 (more preferably at least 10 and still more preferably at least 20) dislocation lines in the peripheral region of the grains.

In the invention, the peripheral region of a grain is the peripheral region of a projection vertical to (100) faces of the grain. Thus, the peripheral region of a silver halide grain is the region of from the edge of a projection from the direction vertical to a (100) face of a cubic silver halide grain to a distance of 20% of the diameter of the grain in the direction vertical to the edge.

In the silver halide grains relating to this invention, dislocation lines may exist in regions other than the foregoing peripheral region.

The dislocation lines in silver halide grains can be directly observed by means of transmission electron microscopy at a low temperature, for example, in accordance with methods described in J. F. Hamilton, Phot. Sci. Eng. 11 (1967) 57 and T. Shiozawa, Journal of the Society of Photographic Science and Technology of Japan, 35 (1972) 213. Silver halide grains are taken out from an emulsion while making sure not to exert any pressure that might cause dislocation in the grains, and they are then placed on a mesh for electron microscopy. The sample is then observed by transmission electron microscopy, while being cooled to prevent the grain from being damaged by the electron beam. Since electron beam penetration is hampered as the grain thickness increases, sharper observations are obtained when using an electron microscope of higher voltage (e.g., at a voltage 200 kV or more for a 0.25 μm thick grain). It is preferred to employ an electron microscope having a still higher acceleration voltage for further thicker grains.

When transmission observation by an electron beam is difficult due to grain thickness, a silver halide grain may be sliced parallel to a (100) face at not more than 0.25 μm thick, while paying close attention so as not to apply pressure to the extent of causing dislocation and the presence/absence of dislocation line can be confirmed by observation of the slice.

In the silver halide grains of this invention, the coefficient of variation of the number of dislocation lines per grain among grains preferably is not more than 30% and more preferably not more than 20%. The coefficient of variation of the number of dislocation lines can be determined by observation of dislocation lines of at least 300 silver halide grains, based on the following equation:

$$K(\%)=(\sigma/\alpha)\times 100$$

where K is the coefficient of variation among grains with respect to the number of dislocation lines per grain, σ is the standard deviation of dislocation lines and α is the average value of dislocation lines per grain.

The silver halide grains refer to those after completion of silver halide grain formation, and nucleus grains or seed grains and grains in the process of grain growth are not included.

Dislocation lines can be introduced into silver halide grains by employing an operation of local formation of an iodide-containing phase and/or a bromide-containing phase by the use of the various iodine compounds and/or bromides described above. Examples thereof include the use of an aqueous iodide salt solution, such as an aqueous potassium iodide solution, the use of a polyiodide compound, as described in S. Nakahara "Mukikagobutsu•Sakutai Jiten" (Dictionary of Inorganic Compound and Complex, page 944, published by Kodan-sha) and the use of iodide-containing silver halide fine-grains or iodide ion-releasing agents, as disclosed in JP-A No. 2-68538. The use of iodide ion-releasing agents and/or bromide ion-releasing agents is preferred, the use of iodide ion-releasing agents is more preferred, and the use of iodide ion-releasing compounds and/or bromide ion-releasing compounds described in JP-A No. 11-271912 is specifically preferred.

The number of dislocation lines within the grain and the region forming dislocation lines can be optimally controlled by optimum selection of the addition amount of the foregoing iodide ion-releasing compounds and/or bromide ion-releasing compounds, the pH value causing iodide ion and/or bromide ion release, the inter-grain distance of silver halide grains, the growth temperature of silver halide grains and the rate of releasing iodide ions and/or bromide ions.

In the process of formation of silver halide grains, the iodide ion-releasing agent and/or bromide ion-releasing agent are added preferably within 50% to 98% of the final grain volume, and more preferably 70% to 95%. In other words, the iodide idn-releasing agent and/or bromide ion-releasing agent are added preferably after adding 50% of total silver and before adding 98% of total silver, and more preferably after adding 70% of total silver and-before adding 95% of total silver. The iodide ion-releasing agent and/or bromide ion-releasing agent are added preferably in an amount of 0.02 to 8 mol % based on silver halide, and more preferably 0.04 to 5 mol %. The pH causing the iodide ion-releasing agent and/or bromide ion-releasing agent to release iodide ion and/or bromide ion is preferably from 5.0 to 12.0, and more preferably from 6.0 to 11.0. The temperature causing the iodide ion-releasing agent and/or bromide ion-releasing agent to release iodide ion and/or bromide ion is preferably from 10 to 80° C., and more preferably from 20 to 70° C. Preferably, concentration by ultrafiltration is conducted to optionally control the inter-grain distance at the time of causing the iodide ion-releasing agent and/or bromide ion-releasing agent to release iodide ion and/or bromide ion. At least two kinds of the iodide ion-releasing agent and/or bromide ion-releasing agent may be used in combination.

In one preferred embodiment of the silver halide grains relating to this invention, the corners on the projection from the direction vertical to a (100) face of the grains are rounded and such grains accounts for at least 50% by number of all of silver halide grains, preferably at least 70% and more preferably at least 80% by number.

The expression, the corners on the projection from the direction vertical to a (100) face of the grains being rounded means that when two linear lines extended from two sides forming (or sandwiching) the corner of each grain are drawn, the corner does not exist at the intersection of the two linear lines and the presence of a face with any face index other than (100) face is not identified. Silver halide grains having rounded corners on the projection from the direction vertical to a (100) face of the grains can be confirmed by magnifying silver halide grains 30,000 to 100,000 times by an electron microscope and observing the projection from the direction vertical to the (100) face.

In the invention, silver halide grains having rounded corners account for at least 50% by number of all of silver halide grains, preferably at least 70% and more preferably at least 80%. The expression, silver halide grains having rounded corners means that when three linear lines extended from three sides forming (or sandwiching) the corner of each grain are drawn, the corner does not exist at the intersection of the three linear lines and the presence of a face with any face index other than (100) face is not identified. Silver halide grains having rounded corners can be identified by magnifying the silver halide grains 30,000 to 100,000 times by an electron microscope and observing the corners with varying a projection angle.

In the silver halide grains of the invention, the corners on the projection from the direction vertical to a (100) face of the grains being rounded means that cubic silver halide grains have substantially rounded edges in the form of the silver halide grains.

In the silver halide grains of the invention, the corners of the grains being rounded means that cubic silver halide grains have substantially rounded apexes in the form of the silver halide grains.

Compounds accelerating physical ripening, so-called silver halide solvents are usable to form rounded corners of silver halide grains or rounded corners on the projection from the direction vertical to a (100) face of silver halide grains. Examples of such silver halide solvents include (a) organic thioethers described in U.S. Pat. Nos. 3,271,157, 3,531,289, 3,574,628; JP-A Nos. 54-1019, 54-158917; and JP-B No. 58-30571 (hereinafter, the term, JP-B refers to Japanese Patent Publication); (b) thiourea derivatives described in JP-A Nos. 53-82408, 55-29829 and 57-77736; (c) silver halide solvents containing a thiocarbonyl group sandwiched with an oxygen or sulfur atom and a nitrogen atom, described in JP-A No. 53-144319; (d) imidazoles described in JP-A No. 54-100717; (e) sulfite salts; (f) thiocyanates; (g) ammonia and ammonium salts; (h) hydroxyalkyl-substituted ethylenediamines described in JP-A No. 57-196228; (i) substituted mercaptotetrazoles described in JP-A No. 57-202531; (j) water-soluble bromide compounds; and (k) benzimidazole derivatives described in JP-A No. 58-54333. There can be employed change in solubility by adjusting a halide concentration in the process of grain formation, but it is preferred to use a compound represented by the following formula (S) and it is specifically preferred to form silver halide grains in the presence of this compound:

formula (S)

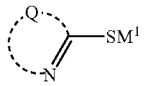

wherein Q is an atomic group necessary to form a 5- or 6-membered nitrogen-containing ring; $M^1$ is a hydrogen atom, alkali metal or a group forming a monovalent cation (or a monovalent cation group).

In the formula (S), examples of the 5-membered ring containing Q include an imidazole ring, tetrazole ring, thiazole ring, oxazole ring, selenazole ring, benzimiazole ring, naphthoimidazole ring, benzothiazole ring, naphthothiazole ring, benzoselenazole ring, naphthoselenazole ring, and benzoxazole ring. Examples of the 6-membered ring containing Q include a pyridine ring, pyrimidine ring and quinoline ring. The 5-membered or 6-membered ring may be substituted. Alkali metals represented by $M^1$ include, for example, sodium atom and potassium atom. Monovalent cation groups represented by $M^1$ include ammonium ion and organic cations.

The mercapto compound represented by the foregoing formula (S) is preferably mercapto compounds represented by the following formula (S-1), (S-2), (S-3) or (S-4). Further, the mercapto compound represented by the following formula (S-1) or (S-2) is specifically preferred.

formula (S-1)

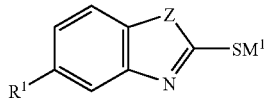

wherein $R^1$ is a hydrogen atom, an alkyl group, an alkoxy group, an aryl group, a halogen atom, a carboxyl group or its salt, a sulfo group or its salt or an amino group; Z is —NH—, —O— or —S—: and $M^1$ is the same as defined in the foregoing formula (S);

formula (S-2)

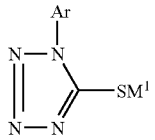

wherein Ar is a group represent by the following formula:

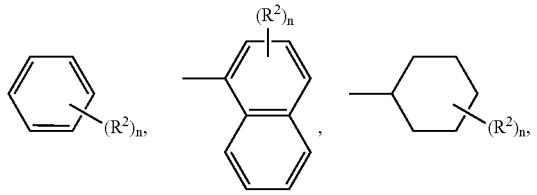

wherein $R^2$ is an alkyl group, an alkoxy group, a carboxy group or its salt, a sulfo group or its salt, a hydroxy group, an amino group, an acylamino group, a carbamoyl group or a sulfonamido group; n is an integer of 0 to 2; $M^1$ is the same as defined in the foregoing formula (S);

formula (S-3)

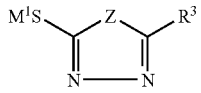

wherein Z is —$NR^3$—, an oxygen atom or a sulfur atom, in which $R^3$ is a hydrogen atom, alkyl group, aryl group, alkenyl group, cycloalkyl group, —$SR^{31}$, —$NR^{32}(R^{33})$—, —$NHCOR^{34}$, —$NHSO_2R^{35}$ or a heterocyclic group, in which $R^{31}$ is a hydrogen atom, alkyl group, alkenyl group, cycloalkyl group, aryl group-$COR^{34}$, or —$SO_2R^{35}$, $R^{32}$ and $R^{33}$ are each a hydrogen atom, alkyl group or aryl group, $R^{34}$ and $R^{35}$ are each an alkyl group or aryl group; $M^1$ is the same as defined in formula (S);

formula (S-4)

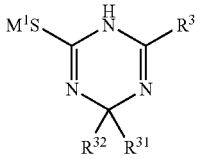

wherein $R^3$ and $M^1$ are each the same as defined in the foregoing formula (S-3); $R^{31}$ and $R^{32}$ are each the same as defined in the foregoing formula (S-3).

In the foregoing formulas (S-1) and (S-2), the alkyl group represented by $R^1$ and $R^2$ includes, for example, methyl, ethyl and butyl; the alkoxy group includes methoxy and ethoxy, salts of the carboxy or sulfo group includes sodium and ammonium salts. In formula (S-1), the aryl group represented by $R^1$ includes, for example, phenyl and naphthyl, and the halogen atom includes, for example, chlorine atom and bromine atom. In formula (S-2), the acylamino group represented by $R^2$ includes, for example, methylcarbonylamino and benzoylamino; the carbamoyl group includes, for example, ethylcarbamoyl and phenylcarbamoyl; and the sulfonamido group includes, for example, methylsulfonamido and phenylsulfonamido. The foregoing alkyl, alkoxy, aryl, amino, acylamino, carbamoyl and sulfonamido groups may be substituted with substituents.

In the foregoing formula (S-3), the alkyl group represented by $R^3$, $R^{31}$, $R^{32}$, $R^{33}$, $R^{34}$ and $R^{35}$ includes, for example, methyl, benzyl, ethyl and propyl; and the aryl group includes, for example, phenyl and naphthyl. The alkenyl group represented by $R^3$ and $R^{31}$ includes, for example, propenyl; the cycloalkyl group includes, for example, cyclohexyl. The heterocyclic group represented by $R^3$ includes, for example, furyl and pyridinyl. The foregoing alkyl or aryl group represented by $R^3$, $R^{31}$, $R^{32}$, $R^{33}$, $R^{34}$ and $R^{35}$, the alkenyl or cycloalkyl group represented by $R^3$ and $R^{31}$ and the heterocyclic group represented by $R^3$ each may be substituted with substituents.

Specific examples of the compound represented by formula (S) are shown below but are by no means limited to these.

S-1-1

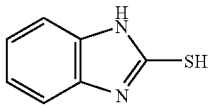

S-1-2

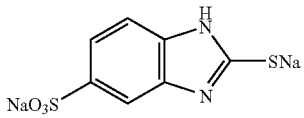

S-1-3

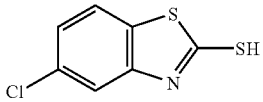

S-1-4

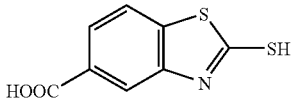

-continued
S-1-5
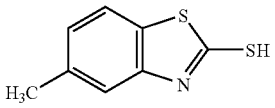
S-1-6
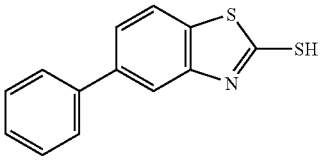
S-1-7
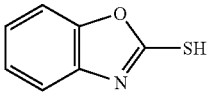
S-1-8
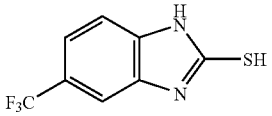
S-2-1
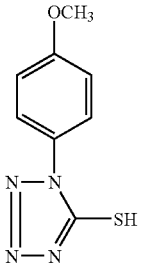
S-2-2
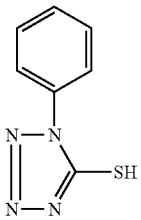
S-2-3
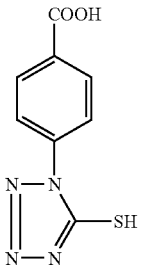
-continued
S-2-4
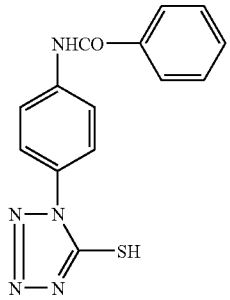
S-2-5
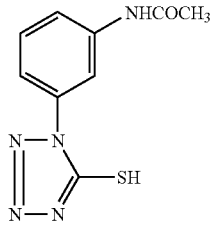
S-2-6
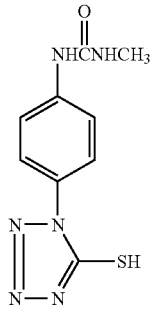
S-2-7
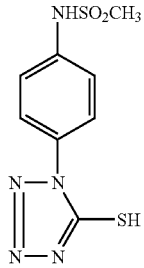
S-2-8
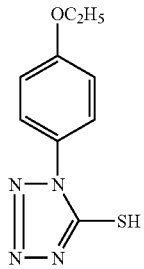

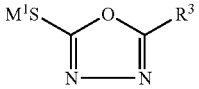
| Compound | $R^3$ | $M^1$ |
|---|---|---|
| S-3-1 | —$C_2H_5$ | —H |
| S-3-2 | —$CH_2$—CH═$CH_2$ | —H |
| S-3-3 | —CH═CH—$CH_2$—$CH_3$ | —H |
| S-3-4 | —$C_7H_{15}$ | —H |
| S-3-5 | —$C_9H_{19}$ | —Na |
| S-3-6 | 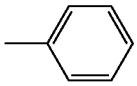 | —H |
| S-3-7 | —$C_4H_9$(t) | —H |
| S-3-8 | 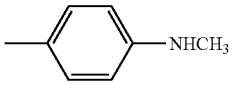 | —H |
| S-3-9 | 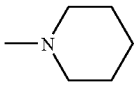 | —H |
| S-3-10 | 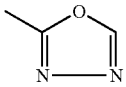 | —H |
| S-3-11 | 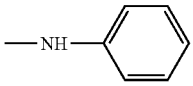 | —H |
| S-3-12 | 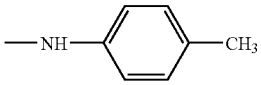 | —H |
| S-3-13 | —$NHCOCH_3$ | —H |
| S-3-14 | 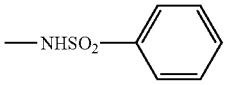 | —H |
| S-3-15 | —$N(CH_3)_2$ | —H |
| S-3-16 | 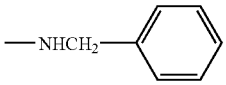 | —H |
| S-3-17 | 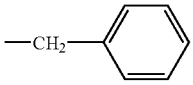 | —H |
| S-3-18 | —S—$CH_3$ | —H |
| S-3-19 | 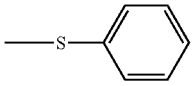 | —H |
| S-3-20 | —SH | —H |

-continued
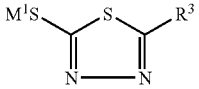
| Compound | $R^3$ | $M^1$ |
|---|---|---|
| S-3-21 | —H | —H |
| S-3-22 | —$C_2H_5$ | —H |
| S-3-23 | —$C_4H_9$(t) | —H |
| S-3-24 | —$C_6H_{13}$ | —H |
| S-3-25 | 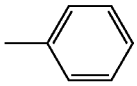 | —H |
| S-3-26 | 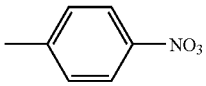 | —H |
| S-3-27 | 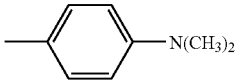 | —H |
| S-3-28 | 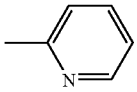 | —H |
| S-3-29 | 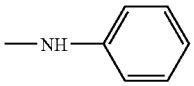 | —H |
| S-3-30 | —NH—$N(CH_3)_2$ | —H |
| S-3-31 | —$CH_2CH$═$CH_2$ | —H |
| S-3-32 | —SH | —H |
| S-3-33 | —$NHCOC_2H_5$ | —H |
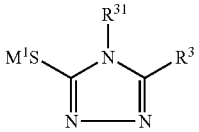
| Compound | $R^3$ | $R^{31}$ | $M^1$ |
|---|---|---|---|
| S-3-34 | —$C_2H_5$ | —H | —H |
| S-3-35 | —$CH_3$ | —$CH_3$ | —H |
| S-3-36 | —$CH_3$ | 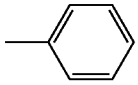 | —H |
| S-3-37 | —$NHCOCH_3$ | —$CH_3$ | —H |
| S-3-38 | 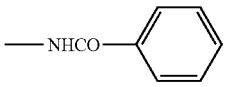 | 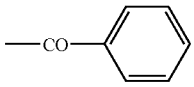 | —H |
| S-3-39 | —$NHCOCH_3$ | —$COCH_3$ | —H |
| S-3-40 | —$NHCOCH_3$ | 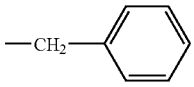 | —H |
| S-3-41 | —$NHCOC_2H_5$ | 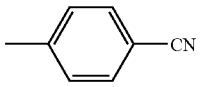 | Na |

-continued
| | | | |
|---|---|---|---|
| S-3-42 | —NHCO— 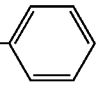 | — 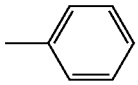 | H |
| S-3-43 | —$NHSO_2CH_3$ | —H | H |
| S-3-44 | —NHCO— 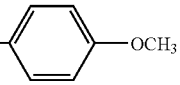 —$OCH_3$ | —$CH_3$ | Na |
| S-3-45 | —NHCO— 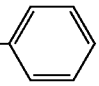 | —$CH_2CH{=}CH_2$ | H |
| S-3-46 | —NHCO— 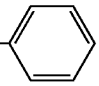 | —$CH_2CH_2O$— 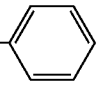 | —H |
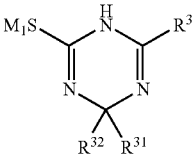
| Compound | $R^3$ | $R^{31}$ | $R^{32}$ | $M^1$ |
|---|---|---|---|---|
| S-4-1 | —$C_2H_5$ | —$CH_3$ | —$CH_3$ | —H |
| S-4-2 | 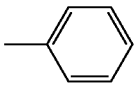 | —$CH_3$ | —$CH_3$ | —H |
| S-4-3 | —$NH_2$ | —H | 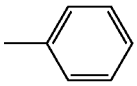 | —H |
| S-4-4 | —NH— 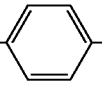 —Cl | —H | —$C_4H_9$ | —H |
| S-4-5 | —$NHCOCH_3$ | —$CH_3$ | —$CH_3$ | —H |
| S-4-6 | —NHCO— 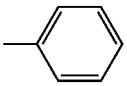 | —$CH_3$ | —$CH_3$ | —H |
| S-4-7 | —NH— 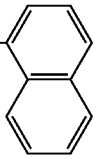 | —$CH_3$ | —$C_3H_7$(i) | —H |
| S-4-8 | 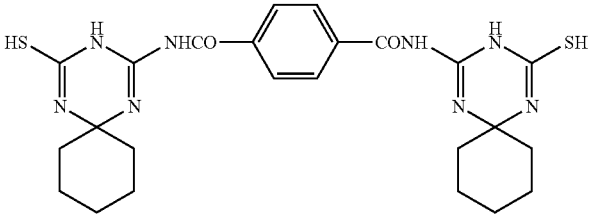 | | | |

The compounds represented by formula (S) include compounds described, for example, in JP-B No. 40-28496, JP-A 50-89034; J. Chem. Soc. 49, 1748 (1927), ibid 4237 (1952); J. Org. Chem. 39, 2469 (1965); U.S. Pat. No. 2,824,001; J. Chem. Soc. 1723 (1951); JP-A No. 56-111846; U.S. Pat. Nos. 1,275,701, 3,266,897, 2,403,927, and can be synthesized in accordance with the synthesis described in the foregoing literature.

To allow the compound represented by formula (S), which is hereinafter also denoted simply as a compound (S), to be included in a silver halide emulsion layer relating to this invention, the compound (S) is incorporated through solution in water or water-miscible organic solvents (e.g., methanol, ethanol). The compound (S) may be used alone or in combination with another compound represented by formula (S), or a stabilizer or antifoggant other than the compounds represented by formula (S). The compound of formula (S) is added preferably in an amount of $1\times10^{-8}$ to 1 mol/mol AgX, and more preferably $1\times10^{-7}$ to $1\times10^{-1}$ mol/mol AgX.

The silver halide emulsion relating to this invention preferably exhibits a coefficient of variation in bromide content among grains of less than 50%, more preferably less than 30% and still more preferably less than 20%. In cases when the silver halide emulsion contains iodide, the coefficient of variation in iodide content among grains is less than 50%, more preferably less than 30% and still more preferably less than 20%.

According to the EPMA method, bromide and iodide contents determined for the individual grains are measured for at least 300 grains and averaged values thereof are defined as the average bromide and iodide contents of the grains. A coefficient of variation of bromide contents among grains and a coefficient of variation of iodide contents among grains can be calculated according to the following equation:

coefficient of variation of bromide contents among grains=[(standard deviation of bromide content of silver halide grains)/(average bromide content)]×100 (%).

coefficient of variation of iodide contents among grains=[(standard deviation of iodide content of silver halide grains)/(average iodide content)]×100 (%).

Silver halide grains preferably include at least one metal complex containing an aqua or organic ligand (or both of them) in combination with a metal of group 8 of the periodical table of elements (which is hereinafter also denoted as a group 8 metal complex containing an aqua or organic ligand). The group 8 metal complex usable in this invention preferably is a metal complex of iridium, rhodium, osmium, ruthenium, cobalt or platinum. The metal complex may be a six-coordinate complex, five-coordinate complex, four-coordinate complex or two-coordinate complex, and a six-coordinate complex and a four-coordinate complex are preferred. Of the foregoing group 8 metal complexes containing an aqua ligand and/or an organic ligand or both of them, an iridium metal complex is preferred.

Any ligand is usable and examples of a ligand include carbonyl ligand, fulminate ligand, thiocyanate ligand, nitrosyl ligand, thionitrosyl ligand, cyano ligand, water ligand [in which water as a ligand is called an aqua (or aquo-) ligand], halogen ligand, ligands of ammonia, a hydroxide, nitrous acid, sulfurous acid and a peroxide and organic ligands. Of these, it is preferred to contain at least one ligand selected from nitrocyl ligand, thionitrocyl ligand, cyano ligand, aqua ligand, halogen ligand and an organic ligand. In this invention, the organic ligand refers to a compound containing at least one of H—C, C—C and C—N—H bonds and capable of being coordinated with a metal ion. Preferred organic ligands usable in this invention include a compound selected from pyridine, pyrazine, pyrimidine, pyrane, pyridazine, imidazole, thiazole, isothiazole, triazole, pyrazole, furan, furazane, oxazole, isooxazole, thiophene, phenthroline, bipyridine and ethylenediamine, their ions and compounds substituted with the foregoing compounds.

Preferred examples of a group 8 metal complex containing at least an aqua ligand and/or an organic ligand are shown below but are by no means limited to these. Any counter cation is usable, including potassium ion, calcium ion, sodium ion ammonium ion. Counter anions for the metal complex include nitrate ion, halide ion and perchlorate ion.

(A-1) $K[IrBr_5(H_2O)]$
(A-2) $K_2[IrBr_5(H_2O)]$
(A-3) $K_3[IrBr_5(H_2O)]$
(A-4) $K_4[IrBr_5(H_2O)]$
(A-5) $K[IrBr_4(H_2O)_2]$
(A-6) $[IrBr_4(H_2O)_2]$
(A-7) $[IrBr_3(H_2O)_3]$
(A-8) $[IrBr_3(H_2O)_3]Br$
(A-9) $K[IrCl_5(H_2O)]$
(A-10) $K_2[IrCl_5(H_2O)]$
(A-11) $K_3[IrCl_5(H_2O)]$
(A-12) $K_4[IrCl_5(H_2O)]$
(A-13) $K[IrCl_4(H_2O)_2]$
(A-14) $[IrCl_4(H_2O)_2]$
(A-15) $[IrCl_3(H_2O)_3]$
(A-16) $[IrBr_3(H_2O)_3]Cl$
(B-1) $K_2[RhCl_5(H_2O)]$
(B-2) $K_2[OsCl_5(H_2O)]$
(B-3) $K_2[RuCl_5(H_2O)]$
(B-4) $K[Rh(NO)\ (H_2O)Cl_4]$
(B-5) $K[Rh(NO)\ (H_2O)Br_4]$
(C-1) $[Ir(bipy)Cl_4]$
(C-2) $[Ir(bipy)Br_4]$
(C-3) $[Ir(bipy)_3]^{2+}$
(C-4) $[Ir(py)_6]^{2+}$
(C-5) $[Ir(phen)_3]^{2+}$
(C-6) $[IrCl_2(bipy)_2]^0$
(C-7) $[Ir(thia)_6]^{2+}$
(C-8) $[IrCl_5(thia)]^{2-}$
(C-9) $[IrCl_4(thia)_2]^-$
(C-10) $[IrCl_5(5\text{-methylthia})]^{2-}$
(C-11) $[IrCl_4(5\text{-methylthia})_2]^-$
(C-12) $[IrBr_5(thia)]^{2-}$
(C-13) $[IrBr_4(thia)_2]^-$
(C-14) $[IrBr_5(5\text{-methylthia})]^{2-}$
(C-15) $[IrBr_4(5\text{-methylthia})_2]^-$
(C-16) $[Ir(phen)\ (bipy)_3]^{2+}$
(C-17) $[Ir\ (im)_6]^{2+}$
(C-18) $[IrCl_5(im)]^{2-}$
(C-19) $[IrCl_4(im)_2]^-$
(C-20) $[IrBr_5(im)]^{2-}$
(C-21) $[IrBr_4(im)_2]^{1-}$
(C-22) $[Ir(NCS)_2(bipy)_2]^0$
(C-23) $[Ir(CN)_2(bipy)_2]^0$
(C-24) $[IrCl_2(bipy)_3]^0$
(C-25) $[IrCl_2(bipy)_2]^0$
(C-26) $[Ir(phen)\ (bipy)_2]^{2+}$
(C-27) $[Ir(NCS)_2(bipy)_2]^0$
(C-28) $[Ir(NCS)_2(bipy)_2]^0$ (C-29) $[Ir(bipy)_2(H_2O)(bipy')_2]^0$
(C-30) $[Ir(bipy)_2(OH)(bipy')]^+$
(C-31) $[Ir(bipy)Cl_4]^{2-}$
(C-32) $[Ir(bipy)_3]^{3+}$
(C-33) $[Ir(py)_6]^{3+}$
(C-34) $[Ir(phen)_3]^{3+}$
(C-35) $[IrCl_2(bipy)_2]^+$
(C-36) $[Ir(thia)_6]^{3+}$
(C-37) $[Ir(phen)(bipy)_3]^{3+}$
(C-38) $[Ir(im)_6]^{3+}$
(C-39) $[Ir(NCS)_2(bipy)_2]^+$
(C-40) $[Ir(CN)_2(bipy)_2]^+$
(C-41) $[IrCl_2(bipy)_3]^+$
(C-42) $[IrCl_2(bipy)_2]^+$
(C-43) $[Ir(phen)(bipy)_2]^{3+}$
(C-44) $[Ir(NCS)_2(bipy)_2]^+$
(C-45) $[Ir(NCS)_2(bipy)_2]^+$
(C-46) $[Ir(bipy)_2(H_2O)(bipy)]^{3+}$
(C-47) $[Ir(bipy)_2(OH)(bipy')]^{2+}$
(D-1) $[Ru(bipy)Cl_4]^-$
(D-2) $[Ru(bipy)_3]^{2+}$
(D-3) $[Ru(py)_6]^{2+}$
(D-4) $[Ru(phen)_3]^{2+}$
(D-5) $[RuCl_2(bipy)_2]^0$
(D-6) $[(Ru(thia)_6]^{2+}$
(D-7) $[Ru(phen)(bipy)_3]^{2+}$
(D-8) $[Ru(im)_6]^{2+}$
(D-9) $[Ru(NCS)_2(bipy)_2]^0$
(D-10) $[Ru(CN)_2(bipy)_2]^0$
(D-11) $[RuCl_2(bipy)_3]^0$
(D-12) $[RuCl_2(bipy)_2]^0$
(D-13) $[Ru(phen)(bipy)_2]^{2+}$
(D-14) $[Ru(NCS)_2(bipy)_2]^0$
(D-15) $[Ru(NCS)_2(bipy)_2]^0$
(D-16) $[Fe(bipy)Cl_4]^-$
(D-17) $[Fe(bipy)_3]^{2+}$
(D-18) $[Fe(py)_6]^{2+}$
(D-19) $[Fe(phen)_3]^{2+}$
(D-20) $[FeCl_2(bipy)_2]^0$
(D-21) $[Fe(thia)_6]^{2+}$
(D-22) $[Fe(phen)(bipy)_3]^{2+}$
(D-23) $[Fe(im)_6]^{2+}$
(D-24) $[Fe(NCS)_2(bipy)_2]^0$
(D-25) $[Fe(CN)_2(bipy)_2]$
(D-26) $[FeCl_2(bipy)_3]^0$
(D-27) $[Fe(NCS)_2(bipy)_2]^0$
(D-28) $[Fe(phen)(bipy)_2]^{2+}$
(D-29) $[Fe(NCS)_2(bipy)_2]^0$
(D-30) $[Fe(NCS)_2(bipy)_2]^0$
(D-31) $[Os(bipy)Cl_4]^-$
(D-32) $[Os(bipy)_3]^{2+}$
(D-33) $[Os(py)_6]^{2+}$
(D-34) $[Os(phen)_3]^{2+}$
(D-35) $[OsCl_2(bipy)_2]^0$
(D-36) $[Os(thia)_6]^{2+}$
(D-37) $[Os(phen)(bipy)_3]^{2+}$
(D-38) $[Os(im)_6]^{2+}$
(D-39) $[Os(NCS)_2(bipy)_2]^0$
(D-40) $[Os(CN)_2(bipy)_2]^0$
(D-41) $[OsCl_2(bipy)_3]^0$
(D-42) $[OsCl_2(bipy)_2]^0$
(D-43) $[Os(phen)(bipy)_2]^{2+}$
(D-44) $[Os(NCS)_2(bipy)_2]^0$
(D-45) $[Os(NCS)_2(bipy)_2]^0$
(D-46) $[Co(bipy)Cl_4]^-$
(D-47) $[Co(bipy)_3]^{2+}$
(D-48) $[Co(py)_6]^{2+}$
(D-49) $[Co(phen)_3]^{2+}$
(D-50) $[CoCl_2(bipy)_2]^0$
(D-51) $[Co(thia)_6]^{2+}$
(D-52) $[Co(phen)(bipy)_3]^{2+}$
(D-53) $[Co(im)_6]^{2+}$
(D-54) $[Co(NCS)_2(BIPY)_2]^0$
(D-55) $[Co(CN)_2(bipy)_2]^0$
(D-56) $[CoCl_2(bipy)_3]^0$
(D-57) $[CoCl_2(bipy)_2]^0$
(D-58) $[Co(phen)(bipy)_2]^{2+}$
(D-59) $[Co(NCS)_2(bipy)_2]^0$
(D-60) $[Co(NCS)_2(bipy)_2]^0$
(D-61) $[Rh(bipy)Cl_4]^-$
(D-62) $[Rh(bipy)_3]^{2+}$
(D-63) $[Rh(py)_6]^{2+}$
(D-64) $[Rh(phen)_3]^{2+}$
(D-65) $[RhCl_2(bipy)_2]^0$
(D-66) $[Rh(thia)_6]^{2+}$
(D-67) $[Rh(phen)(bipy)_3]^{2+}$
(D-68) $[Rh(im)_6]^{2+}$
(D-69) $[Rh(NCS)_2(bipy)_2]^0$
(D-70) $[Rh(CN)_2(bipy)_2]^0$
(D-71) $[RhCl_2(bipy)_3]^0$
(D-72) $[RhCl_2(bipy)_2]^0$
(D-73) $[Rh(phen)(bipy)_2]^{2+}$
(D-74) $[Rh(NCS)_2(bipy)_2]^0$
(D-75) $[Rh(NCS)_2(bipy)_2]^0$ In the foregoing group 8 metal compounds and group 8 metal complexes, abbreviation terms are as follows:

bipy: bipyridine bidendate ligand
bipy': bipyridine monodendate ligand
im: imidazole
py: pyridine
phen: phenthroline
thia: thiazole
5-methylthia: 5-methylthiazole In addition, bipyridine complexes described in JP-A No. 5-341426 are preferably usable.

Further to addition of at least a group 8 metal complex containing an aqua ligand and/or organic ligand in the preparation of silver halide grains, it is preferred to add a group 8 metal complex represented by the following formula:

$$R_n[MX_mY_{6-m}] \qquad \text{formula (A)}$$

wherein M is a metal selected from group 8 elements of the periodical table (preferably iron, cobalt, ruthenium, iridium, rhodium, osmium and platinum, and more preferably iron, ruthenium, iridium, rhodium, osmium); R is an alkali metal (preferably cesium, sodium and potassium); m is an integer of 0 to 6, and n is an integer of 0 to 4; X and Y are each a ligand, including carbonyl ligand, fulminate ligand, thiocyanate ligand, nitrosyl ligand, thionitrosyl ligand, cyano ligand, aqua ligand, halogen ligand, ligands of ammonia, a hydroxide, nitrous acid, sulfurous acid and a peroxide ligands.

Specific examples of the group 8 metal compound and group 8 metal complex are shown below but are by no means limited to these. Any counter cation is usable, including potassium ion, calcium ion, sodium ion ammonium ion. Counter anions for the metal complex include nitrate ion, halide ion and perchlorate ion.

E-1: $K_2[IrCl_6]$
E-2: $K_3[IrCl_6]$
E-3: $K_2[Ir(CN)_6]$
E-4: $K_3[Ir(CN)_6]$

E-5: $K_2[Ir(NO)((CN)_5)]$
E-6: $K_2[IrBr_6]$
E-7: $K_3[IrBr_6]$
E-8: $K_2[IrBr_4Cl_2]$
E-9: $K_3[IrBr_4Cl_2]$
E-10: $K_2[IrBr_3Cl_3]$
E-11: $K_3[IrBr_3Cl_3]$
E-12: $K_2[IrBr_5Cl]$
E-13: $K_3[IrBr_5Cl]$
E-14: $K_2[IrBr_5I]$
E-15: $K_3[IrBr_5I]$
E-16: $K_3[IrBr(CN)_5]$
E-17: $K_3[IrBr_2(CN)_4]$
E-18: $K_2[Ir(CN)_5(H_2O)]$
E-19: $K_3[Ir(CN)_5(H_2O)]$
E-20: $K[Ir(NO)Cl_5]$
E-21: $K[Ir(NS)Cl_5]$
F-1: $K_2[RuCl_6]$
F-2: $K_2[FeCl_6]$
F-3: $K_2[PtCl_6]$
F-4: $K_3[RhCl_6]$
F-5: $K_2[OsCl_6]$
F-6: $K_2[RuBr_6]$
F-7: $K_2[FeBr_6]$
F-8: $K_2[PtBr_6]$
F-9: $K_3[RhBr_6]$
F-10: $K_2[OsBr_6]$
F-11: $K_2[Pt(SCN)_4]$
F-12: $K_4[Ru(CNO)_6]$
F-13: $K_4[Fe(CNO)_6]$
F-14: $K_2[Pt(CNO)_4]$
F-15: $K_3[Co(NH_3)_6]$
F-16: $K_3[Co(CNO)_6]$
F-17: $K_4[Os(CNO)_6]$
F-18: $Cs_2[Os(NO)Cl_5]$
F-19: $K_2[Ru(NO)Cl_5]$
F-20: $K_2[Ru(CO)Cl_5]$
F-21: $Cs_2[Os(CO)Cl_5]$
F-22: $K_2[Fe(NO)Cl_5]$
F-23: $K_2[Ru(NO)Br_5]$
F-24: $K_2[Ru(NO)I_5]$
F-25: $K_2[Ru(NS)Cl_5]$
F-26: $K_2[Os(NS)Cl_5]$
F-27: $K_2[Ru(NS)Br_5]$
F-28: $K_2[Ru(NS)(SCN)_5]$
F-29: $K_2[RuBr_6]$
F-30: $K_2[FeBr_6]$
F-31: $K_4[Fe(CN)_6]$
F-32: $K_3[Fe(CN)_6]$
F-33: $K_4[Ru(CN)_6]$
F-34: $K_4[Os(CN)_6]$
F-35: $K_3[Rh(CN)_6]$
F-36: $K_4[RuCl(CN)_5]$
F-37: $K_4[OsBr(CN)_5]$
F-38: $K_4[OsCl(CN)_5]$
F-39: $K_3[RhF(CN)_5]$
F-40: $K_3[Fe(CO)(CN)_5]$
F-41: $K_4[RuF_2(CN)_4]$
F-42: $K_4[OsCl_2(CN)_4]$
F-43: $K_4[RhI_2(CN)_4]$
F-44: $K_4[Ru(CN)_5(OCN)]$
F-45: $K_4[Ru(CN)_5(N_3)_4]$
F-46: $K_4[Os(CN)_5(SCN)]$
F-47: $K_4[Rh(CN)_5(SeCN)]$
F-48: $K_4[RuF_2(CN)_4]$
F-49: $K_3[Fe(CN)_3Cl_3]$
F-50: $K_4[Os(CN)Cl_5]$
F-51: $K_3[Co(CN)_6]$
F-52: $K_2[RuBr(CN)_5]$
F-53: $K_2[Os(NS)(CN)_5]$
F-54: $K[Ru(NO)_2Cl_4]$
F-55: $K_4[Ru(CN)_5(N_3)_4]$
F-56: $K_2[Os(NS)Cl(SCN)_4]$
F-57: $K_2[Ru(NS)(I)_5]$
F-58: $K_2[Os(NS)Cl_4(TeCN)_4]$
F-59: $K_2[Rh(NS)Cl_5]$
F-60: $K_2[Ru(NO)(CN)_5]$
F-61: $K[Rh(NO)_2Cl_4]$
F-62: $K_2[Rh(NO)Cl_5]$

To allow the foregoing Group 8 metal compounds to be included, doping may be conducted during physical ripening of silver halide grains or in the course of forming silver halide grains (in general, during addition of water-soluble silver salt and alkali halide). Alternatively, forming silver halide grains is interrupted and doping is carried out, then, the grain formation is continued. Doping can also be conducted by performing nucleation, physical ripening or grain formation in the presence of a Group 8 metal compound.

The Group 8 metal compound is used in an amount of $1\times10^{-9}$ to $1\times10^{-2}$ mol, preferably $5\times10^{-9}$ to $1\times10^{-3}$ mol, and more preferably $1\times10^{-8}$ to $1\times10^{-4}$ mol per mol of silver halide. Commonly known methods of adding additives to a silver halide emulsion are applicable to allow the Group 8 metal compound to be included in silver halide grains, for example, the compound may be directly dispersed in an emulsion or incorporated through solution in solvents such as water, methanol and ethanol. A method of preparing a silver halide emulsion, in which fine silver halide grains including a Group 8 metal compound are added during grain formation can be referred to a method described in JP-A Nos. 11-212201 and 2000-89403.

Silver halide grain emulsions relating are preferably sensitized with selenium sensitizers. Labile selenium compounds capable of forming silver selenide upon reaction with aqueous silver nitrate are used as a selenium sensitizer. Examples thereof are described in U.S. Pat. Nos. 1,574,944, 1,602,592 and 1,623,499; JP-A Nos. 60-150046, 4-25832, 4-109240 and 4-147250. Examples of useful selenium sensitizers include colloidal selenium, isoselenocyanates (e.g., allyl isoselenocyanate), selenoureas (e.g., N,N-dimethylselenourea, N,N,N'-triethylselenourea, N,N,N',N'-tetramethylselenourea, N,N,N'-trimethyl-N'-heptafluoropropylselenourea, N,N'-dimethyl-N,N'-bis(carboxymethyl)selenourea, N,N,N'-trimethyl-N'-heptafluoropropylcarbonylselenourea, N,N,N'-trimethyl-N'-4-nitrophenylcarbonylselenourea), selenoketones (e.g., selenoacetone, selenoacetophenone), selenoamides (e.g., selenoacetoamide, N,N-dimethylselenobenzamide), selenocarboxylic acids and selenoesters (e.g., 2-selenopropionic acid, methyl-3-selenobutylate), selenophosphates (e.g., tri-p-triselenophosphate, pentafluorophenyl-diphenylselenophosphate), and selenides (e.g., dimethylselenide, tributylphosphine selenide, triphenylphosphine selenide, tri-p-tolylphosphine selenide, pentafluorophenyl-diphenylphosphine selenide, trifurylphosphine selenide, tripyridylphosphine selenide) Of these, selenium sensitizers, selenoureas, selenoamides and selenides are preferred.

Specific examples of technique for using selenium sensitizers are described in U.S. Pat. Nos. 1,574,944, 1,602,592, 1,623,499, 3,297,466, 3,297447, 3,320,069, 3,408196, 3,408197, 3,442,653, 3,420,670, and 3,591,385; French Patent Nos. 2,693,038. and 2,093,209; JP-B Nos. 52-34491, 52-34492, 53-295 and 57-22090; JP-A Nos. 59-180536, 59-185330, 59-181337, 59-187338, 59-192241, 60-150046, 60-151637, 61-246738, 3-4221, 3-24537, 3-111838, 3-116132, 3-148648, 3-237450, 4-16838, 4-25832, 4-32831, 4-33043, 4-96059, 4-109240, 4-140738, 4-140739, 4-147250, 4-184331, 4-190225, 4-191729, 4-195035, 5-11385, 5-40324, 5-24332, 5-24333, 5-303157, 5-306268, 6-306269, 6-27573, 6-75328, 6-175259, 6-208184, 6-208186, 6-317867, 7-92599, 7-98483, 7-104415, 7-140579, 7-301879, 7-301880, 8-114882, 9-19760, 9-138475, 9-166941, 9-138375, 9-189979, 10-10666 and 2001-343721; British Patent Nos. 255,846 and 861,984; and H. E. Spencer, Journal of Photographic Science, 31, 158–169 (1983).

A selenium sensitizer is added preferably in an amount of $1\times10^{-9}$ to $1\times10^{-5}$ mol per mol of silver halide, and more preferably $1\times10^{-8}$ to $1\times10^{-5}$ mol. Selenium sensitizers are added to a silver halide emulsion in such a manner that additives are usually incorporated to photographic emulsion. For example, a water-soluble compound is dissolved in water and a water-insoluble or sparingly water-soluble compound is dissolved in a water-miscible solvent exhibiting no adverse effect on photographic characteristics, such as alcohols, glycols, ketones, esters, and amides, and they are added in the form of solution.

Sulfur sensitizers may be used in combination with selenium sensitizers. Specific examples of preferred sulfur sensitizers include thiourea derivatives such as 1,3-diphenylthiourea, triethylthiourea and 1-ethyl-3-(2-thiazolyl)thiourea; rhodanine derivatives, dithiocarbamic acids, polysulfide organic compounds, thiosulfates, and simple substance of sulfur. Of simple substance of sulfur, rhombic α-sulfur is preferred. There are also usable sulfur sensitizers described in U.S. Pat. Nos. 1,574,944, 2,410,689, 2,278,947, 2,728,668, 3,501,313, and 3,656,955; West German Patent No. 1,422,869; JP-A Nos. 56-24937 and 55-45016.

There may be simultaneously used noble metal salts such as gold, platinum, palladium and iridium described in Research Disclosure (hereinafter, also denoted simply as RD). Of these, the use of a gold sensitizer is specifically preferred. Examples of useful gold sensitizers include chloroauric acid, gold thiosulfate, gold thiocyanic acid and organic gold compounds described in U.S. Pat. Nos. 2,597,856 and 5,049,485; JP-B No. 44-15748 and JP-A Nos. 1-147537 and 4-70650. When performing sensitization by using a gold complex, ligands for gold, such as a thiosulfate, thiocyanate, and thioether are preferably used as an auxiliary agent and the use of a thiocyanate is specifically preferred. The addition amount of a sulfur sensitizer or a gold sensitizer, depending on the kind of a silver halide grain emulsion, the kind of a used compound and ripening conditions, is preferably $1\times10^{-9}$ to $1\times10^{-5}$ mol per mol of silver halide, and more preferably $1\times10^{-8}$ to $1\times10^{-5}$ mol.

Various sensitizes described above may be added in accordance with properties of a sensitizer, for example, by solution in water or organic solvents such as methanol, by a mixture with a gelatin solution or by a method described in JP-A No. 4-140739, i.e., addition in the form of emulsified dispersion of a solution mixed with a polymer soluble in an organic solvent.

Reduction sensitizers may be further used and reducing compounds described in RD vol. 307, 307105 and JP-A No. 7-78685 are usable. Specific examples thereof include aminoiminomethanesulfinic acid (thiourea dioxide), borane compounds (e.g., dimethylaminoborane), hydrazine compounds (e.g., hydrazine, p-tolylhydrazine), polyamine compounds (e.g., diethylenetriamine, triethylenetetramine), stannous chloride, silane compounds, reductones (e.g., ascorbic acid), sodium sulfite, aldehyde compounds and hydrogen gas. Further, reduction sensitization may be conducted at a relatively high pH or in an atmosphere of excessive silver ions, as described in Japanese Patent Application Nos. 8-277938, 8-251486 and 8-182035.

It is preferred that the silver halide emulsion of this invention includes a gelatin which contains substantially,no calcium ion. The gelatin which contains substantially no calcium ion is one having a calcium content of 100 ppm or less, preferably 50 ppm or less, and more preferably 30 ppm or less. A gelatin which contains substantially no calcium ion can be obtained by a cationic deionization process with ion-exchange resins. A gelatin which contains substantially no calcium ion is preferably used in at least one of the processes of silver halide grain formation, desalting, dispersion, and chemical sensitization and/or spectral sensitization, and more preferably prior to chemical sensitization and/or spectral sensitization. A gelatin which contains substantially no calcium ion preferably accounts for at least 10% by weight of the whole.dispersing medium of a prepared silver halide emulsion, more preferably at least 30%, and still more preferably at least 50%.

A chemically modified gelatin of which amino group is substituted is preferably used in the preparation of a silver halide emulsion of this invention to perform the formation and/or desalting of silver halide grains. Examples of such a chemically modified gelatin include modified gelatins described in JP-A Nos. 5-72658, 9-197595 and 9-251193 in which an amino group of gelatin has been substituted. The use of a chemically modified gelatin in the process of grain formation and/or desalting is preferably in an amount of at least 10% by weight of the whole dispersing medium, more preferably at least 30%, and still more preferably at least 50%. The substitution ratio of an amino group is preferably at least 30%, more preferably at least 50%, and still more preferably at least 80%.

Preferably, a silver halide emulsion is desalted after completion of grain formation. Desalting is conducted in such a manner, for example, as described in RD 17643, sect. II. Specifically, to remove unwanted soluble salts from a precipitation product or a physically ripened emulsion, a noodle washing method may be used, or inorganic salts, anionic surfactants or anionic polymers [e.g., poly(styrene sulfonic acid)] are also usable, but a flocculation method using gelatin derivatives or chemically modified gelatin (e.g., acylated gelatin and carbamoylated gelatin) and a ultrafiltration method employing membrane separation are preferred. The ultrafiltration method employing membrane separation is referred to "Kagaku Kogaku Binran (Handbook of Chemical Engineering)" 5th ed., page 924–954; RD vol. 102, 10208 and vol. 131, 13122; JP-B Nos. 59-43727 and 62-27008; JP-A Nos. 62-113137, 57-209823, 59-43727, 61-219948, 62-23035, 63-40137, 63-40039, 3-140946, 2-172816, 2-172817 and 4-22942. Ultrafiltration is conducted preferably employing an apparatus or a method described in JP-A Nos. 11-339923 and 11-231448.

Dispersing medium used in the preparation of silver halide emulsions is a compound exhibiting a protective colloid property for silver halide grains. Preferably, the dispersing medium is allowed to exist in the nucleation and growth stages of silver halide grain formation. Preferred dispersing mediums usable in this invention include gelatin and hydrophilic colloids. Preferred examples of gelatin usable in this invention include an alkali process or acid process gelatin having a molecular weight of ca. 100,000, an oxidized gelatin, and enzymatic process gelatin described in Bull. Soc. Sci. Photo. Japan No. 16, page 30 (1966). A gelatin an average molecular weight of 10,000 to 50,000 is preferably used in the nucleation stage of silver halide grains. To reduce the average molecular weight, gelatin is degraded by using a gelatin degradation enzyme or hydrogen peroxide. The use of a gelatin having a relatively low methionine content in the nucleation stage is preferred specifically in the preparation of tabular silver halide grains. The methionine content is preferably not more than 50 μmol per unit weight (g) of dispersing medium, and more preferably not more than 20 μmol. The methionine content can be reduced by subjecting gelatin to an oxidation treatment by using hydrogen peroxide and the like.

Examples of a hydrophilic colloid include gelatin derivatives, a graft polymer of gelatin with other polymers, proteins such as albumin or casein; cellulose derivatives such as hydroxyethyl cellulose, carboxymethyl cellulose, cellulose sulfuric acid esters; saccharide derivatives such as sodium alginate and starch derivatives and synthetic hydrophilic polymeric materials of homopolymers such as polyvinyl alcohol and its partial acetal, poly-N-vinylpyrrolidone, polyacrylic acid, polymethacrylic acid, polyacrylamide, polyvinylimidazole, and polyvinylpyrazole and their copolymers. Examples of usable gelatin usable include an alkali process gelatin, acid process gelatin, an oxidized gelatin, and enzymatic process gelatin described in Bull. Soc. Sci. Photo. Japan No. 16, page 30 (1966). There are also usable hydrolytic products and enzymatic degradation products of gelatin.

There can be employed a variety of apparatuses and methods for preparing silver halide emulsions, which are generally known in the art. The silver halide can be prepared according to any of acidic precipitation, neutral precipitation and ammoniacal precipitation. Silver halide grains can formed through a single process, or through forming seed grains and growing them. A process for preparing seed grains and a growing process thereof may be the same with or different from each other. Normal precipitation, reverse precipitation, double jet precipitation or a combination thereof is applicable as a reaction mode of a silver salt and halide salt, and the double jet precipitation is preferred. As one mode of the double jet precipitation is applicable a pAg-controlled double jet method described in JP-A 54-48521.

There can be employed a apparatus for supplying a silver salt aqueous solution and a halide aqueous solution through an adding apparatus provided in a reaction mother liquor, as described in JP-A 57-92523 and 57-92524; an apparatus for adding silver salt and halide solutions with continuously varying the concentration thereof, as described in German Patent 2,921,164; and an apparatus for forming grains in which a reaction mother liquor is taken out from the reaction vessel and concentrated by ultra-filtration to keep constant the distance between silver halide grains.

Solvents for silver halide such as thioethers are optionally employed. A compound containing a mercapto group, nitrogen containing heterocyclic compound or a compound such as a sensitizing dye can also be added at the time of forming silver halide grains or after completion thereof.

In silver halide emulsions, sensitization using gold compounds and sensitization using chalcogen sensitizers may be used in combination. Chalcogen sensitizers applicable to silver halide emulsion include a sulfur sensitizer, selenium sensitizer and tellurium sensitizer. Examples of a sulfur sensitizer include a thiosulfate, allylthiocarbamate, thiourea, allylisothiacyanate, cystine, p-toluenethiosulfonate, rhodanine and inorganic sulfur. The addition amount of a sulfur sensitizer, which is variable depending on the kind of silver halide and expected effects, is usually from $5\times10^{-10}$ to $5\times10^{-5}$ mol per mol of silver halide, and preferably from $5\times10^{-8}$ to $3\times10^{-5}$ mol per mol of silver halide. Gold sensitizers include, for example, chloroauric acid, gold sulfide and various gold complexes, in which ligand compounds include dimethylrhodanine, thiocyanic acid, mercaptotetrazole, and mercaptotriazole. The amount of a gold compound to be used, depending on the kind of silver halide, the kind of a compound and ripening conditions, is usually from $1\times10^{-8}$ to $1\times10^{-4}$ and preferably $1\times10^{-8}$ to $1\times10^{-5}$ mol per mol of silver halide. There may be employed reduction sensitization as chemical sensitization for silver halide emulsions.

A antifoggant or a stabilizer known in the art are incorporated into the photographic material, for the purpose of preventing fog produced during the process of preparing the photographic material, reducing variation of photographic performance during storage or preventing fog produced in development. Examples of preferred compounds for the purpose include compounds represented by formula (II) described in JP-A 2-146036 at page 7, lower column.

These compounds are added in the step of preparing a silver halide emulsion, the chemical sensitization step or during the course of from completion of chemical sensitization to preparation of a coating solution. In cases when chemical sensitization is undergone in the presence of these compounds, the amount thereof is preferably $1\times10^{-8}$ to $5\times10^{-4}$ mole per mole of silver halide. In cases when added after chemical sensitization, the amount thereof is preferably $1\times10^{-6}$ to $1\times10^{-2}$, and more preferably $1\times10^{-5}$ to $5\times10^{-3}$ mol per mole of silver halide. In cases when added at the stage of preparing a coating solution, the amount is preferably $1\times10^{-6}$ to $1\times10^{-1}$, and more preferably $1\times10^{-5}$ to $1\times10^{-2}$ mole per mol of silver halide. In case where added to a layer other than a silver halide emulsion layer, the amount is preferably $1\times10^{-9}$ to $1\times10^{-3}$ mole/$m^2$.

There are employed dyes having absorption at various wavelengths for anti-irradiation and anti-halation in the photographic material relating to the invention. A variety of dyes known in the art can be employed, including dyes having absorption in the visible range described in JP-A 3-251840 at page 30, AI-1 to 11, and JP-A No. 6-3770; infra-red absorbing dyes described in JP-A No. 1-280750 at page 2, left lower column, formula (I), (II) and (III). These dyes do not adversely affect photographic characteristics of a silver halide emulsion and there is no stain due to residual dyes. For the purpose of improving sharpness, the dye is preferably added in an amount that gives a reflection density at 680 nm of 0.7 to 3.0 and more preferably 0.8 to 3.0.

Fluorescent brightening agents are also incorporated into the photographic material to improve whiteness. Examples of preferred compounds include those represented by formula II described in JP-A No. 2-232652.

In cases when a silver halide photographic light sensitive material according to the invention is employed as a color photographic material, the photographic material comprises layer(s) containing silver halide emulsion(s) which are spectrally sensitized in the wavelength region of 400 to 900 nm, in combination with a yellow coupler, a magenta coupler and a cyan coupler. The silver halide emulsion contains one or more kinds of sensitizing dyes, singly or in combination thereof.

In the silver halide emulsions can be employed a variety of spectral-sensitizing dyes known in the art. Compounds BS-1 to 8 described in JP-A 3-251840 at page 28 are preferably employed as a blue-sensitive sensitizing dye. Compounds GS-1 to 5 described in JP-A 3-251840 at page 28 are preferably employed as a green-sensitive sensitizing dye. Compounds RS-1 to 8 described in JP-A 3-251840 at page 29 are preferably employed as a red-sensitive sensitizing dye. In cases where exposed to infrared ray with a semiconductor laser, infrared-sensitive sensitizing dyes are employed. Compounds IRS-1 to 11 described in JP-A 4-285950 at pages 6–8 are preferably employed as a blue-sensitive sensitizing dye. Supersensitizers SS-1 to SS-9 described in JP-A 4-285950 at pages 8–9 and compounds S-1 to S-17 described in JP-A 5-66515 at pages 5–17 are preferably included, in combination with these blue-sensitive, green-sensitive and red-sensitive sensitizing dyes. The sensitizing dye is added at any time during the course of silver halide grain formation to completion of chemical sensitization. The sensitizing dye is incorporated through solution in water-miscible organic solvents such as methanol, ethanol, fluorinated alcohol, acetone and dimethylformamide or water, or in the form of solid particle dispersion.

As couplers used in silver halide photographic materials relating to the invention is usable any compound capable of forming a coupling product exhibiting an absorption maximum at the wavelength of 340 nm or longer, upon coupling with an oxidation product of a developing agent. Representative examples thereof include yellow dye forming couplers exhibiting an absorption maximum at the wavelength of 350 to 500 nm, magenta dye forming couplers exhibiting an absorption maximum at the wavelength of 500 to 600 nm and cyan dye forming couplers exhibiting an absorption maximum at the wavelength of 600 to 750 nm.

Examples of preferred cyan couplers include those which are represented by general formulas (C-I) and (C-II) described in JP-A 4-114154 at page 5, left lower column. Exemplary compounds described therein (page 5, right lower column to page 6, left lower column) are CC-1 to CC-9.

Examples of preferred magenta couplers include those which are represented by general formulas (M-I) and (M-II) described in JP-A No. 4-114154 at page 4, right upper column. Exemplary compounds described therein (page 4, left lower column to page 5, right upper column) are MC-1 to MC-11. Of these magenta couplers are preferred couplers represented by formula (M-I) described in the foregoing document, page 4, right upper column; and couplers in which $R_M$ in formula (M-I) is a tertiary alkyl group are specifically preferred. Further, couplers MC-8 to MC-11 are superior in color reproduction of blue to violet and red, and in representation of details.

Examples of preferred yellow couplers include those which are represented by general formula (Y-I) described in JP-A No. 4-114154 at page 3, right upper column. Exemplary compounds described therein (page 3, left lower column) are YC-1 to YC-9. Of these yellow couplers are preferred couplers in which RY1 in formula (Y-I) is an alkoxy group are specifically preferred or couplers represented by formula [I] described in JP-A No. 6-67388. Specifically preferred examples thereof include YC-8 and YC-9 described in JP-A No. 4-114154 at page 4, left lower column and Nos. (1) to (47) described in JP-A No. 6-67388 at pages 13–14. Still more preferred examples include compounds represented by formula [Y-1] described in JP-A No. 4-81847 at page 1 and pages 11–17.

When an oil-in-water type-emulsifying dispersion method is employed for adding couplers and other organic compounds used for the photographic material of the present invention, in a water-insoluble high boiling organic solvent, whose boiling point is 150° C. or more, a low boiling and/or a water-soluble organic solvent are combined if necessary and dissolved. In a hydrophilic binder such as an aqueous gelatin solution, the above-mentioned solutions are emulsified and dispersed by the use of a surfactant. As a dispersing means, a stirrer, a homogenizer, a colloidal mill, a flow jet mixer and a supersonic dispersing machine may be used. Preferred examples of the high boiling solvents include phthalic acid esters such as dioctyl phthalate, diisodecyl phthalate, and dibutyl phthalate; and phosphoric acid esters such as tricresyl phosphate and trioctyl phosphate. High boiling solvents having a dielectric constant of 3.5 to 7.0 are also preferred. These high boiling solvents may be used in combination. Instead of or in combination with the high boiling solvent is employed a water-insoluble and organic solvent-soluble polymeric compound, which is optionally dissolved in a low boiling and/or water-soluble organic solvent and dispersed in a hydrophilic binder such as aqueous gelatin using a surfactant and various dispersing means. In this case, examples of the water-insoluble and organic solvent-soluble polymeric compound include poly(N-t-butylacrylamide).

As a surfactant used for adjusting surface tension when dispersing or coating photographic additives, the preferable compounds are those containing a hydrophobic group having 8 through 30 carbon atoms and a sulfonic acid group or its salts in a molecule. Exemplary examples thereof include A-1 through A-11 described in JP-A No. 64-26854. In addition, surfactants, in which a fluorine atom is substituted to an alkyl group, are also preferably used. The dispersion is conventionally added to a coating solution containing a silver halide emulsion. The elapsed time from dispersion until addition to the coating solution and the time from addition to the coating solution until coating are preferably short. They are respectively preferably within 10 hours, more preferably within 3 hours and still more preferably within 20 minutes.

To each of the above-mentioned couplers, to prevent color fading of the formed dye image due to light, heat and humidity, an anti-fading agent may be added singly or in combination. The preferable compounds or a magenta dye are phenyl ether type compounds represented by Formulas I and II in JP-A No. 2-66541, phenol type compounds represented by Formula IIIB described in JP-A No. 3-174150, amine type compounds represented by Formula A described in JP-A No. 64-90445 and metallic complexes represented by Formulas XII, XIII, XIV and XV described in JP-A No. 62-182741. The preferable compounds to form a yellow dye and a cyan dye are compounds represented by Formula I' described in JP-A No. 1-196049 and compounds represented by Formula II described in JP-A No. 5-11417.

A compound (d-11) described in JP-A No. 4-114154 at page 9, left lower column and a compound (A'-1) described in the same at page 10, left lower column are also employed for allowing the absorption wavelengths of a dye to shift. Besides can also be employed a compound capable of releasing a fluorescent dye described in U.S. Pat. No. 4,774,187.

It is preferable that a compound reacting with the oxidation product of a color developing agent be incorporated into a layer located between light-sensitive layers for preventing color staining and that the compound is added to the silver halide emulsion layer to decrease fogging. As a compound for such purposes, hydroquinone derivatives are preferable, and dialkylhydroquinone such as 2,5-di-t-octyl hydroquinone are more preferable. The specifically preferred compound is a compound represented by Formula II described in JP-A No. 4-133056, and compounds II-1 through II-14 described in the above-mentioned specification pp. 13 through 14 and compound 1 described on page 17.

In the photographic material according to the present invention, it is preferable that static fogging is prevented and light-durability of the dye image is improved by adding a UV absorber. The preferable UV absorbent is benzotriazoles. The specifically preferable compounds are those represented by Formula III-3 in JP-A No. 1-250944, those represented by Formula III described in JP-A No. 64-66646, UV-1L through UV-27L described in JP-A No. 63-187240, those represented by Formula I described in JP-A No. 4-1633 and those represented by Formulas (I) and (II) described in JP-A No. 5-165144.

In the photographic materials used in the invention is advantageously employed gelatin as a binder. Furthermore, there can be optionally employed other hydrophilic colloidal materials, such as gelatin derivatives, graft polymers of gelatin with other polymers, proteins other than gelatin, saccharide derivatives, cellulose derivatives and synthetic hydrophilic polymeric materials. A vinylsulfone type hardening agent or a chlorotriazine type hardening agent is employed as a hardener of the binder, and compounds described in JP-A 61-249054 and 61-245153 are preferably employed. An antiseptic or antimold described in JP-A 3-157646 is preferably incorporated into a hydrophilic colloid layer to prevent the propagation of bacteria and mold which adversely affect photographic performance and storage stability of images. A lubricant or a matting agent is also preferably incorporated to improve surface physical properties of raw or processed photographic materials.

A variety of supports are employed in the photographic material used in this invention, including paper coated with polyethylene or polyethylene terephthalate, paper support made from natural pulp or synthetic pulp, polyvinyl chloride sheet, polypropylene or polyethylene terephthalate supports which may contain a white pigment, and baryta paper. Of these supports a paper support coated, on both sides, with water-proof resin layer. As the water-proof resin are preferably employed polyethylene, ethylene terephthalate and a copolymer thereof. Inorganic and/or organic white pigments are employed, and inorganic white pigments are preferably employed. Examples thereof include alkaline earth metal sulfates such as barium sulfate, alkaline earth metal carbonates such as calcium carbonate, silica such as fine powdery silicate and synthetic silicate, calcium silicate, alumina, alumina hydrate, titanium oxide, zinc oxide, talc, and clay. Preferred examples of white pigments include barium sulfate and titanium oxide. The amount of the white pigment to be added to the water-proof resin layer on the support surface is preferably not less than 13% by weight, and more preferably not less than 15% by weight to improve sharpness. The dispersion degree of a white pigment in the water-proof resin layer of paper support can be measured in accordance with the procedure described in JP-a 2-28640. In this case, the dispersion degree, which is represented by a coefficient of variation, is preferably not more than 020, and more preferably not more than 0.15.

Supports having a center face roughness (Sra) of 0.15 nm or less (preferably, 0.12 nm or less) are preferably employed in terms of glossiness. Trace amounts of a blueing agent or reddening agent such as ultramarine or oil-soluble dyes are incorporated in a water-proof resin layer containing a white pigment or hydrophilic layer(s) of a reflection support to adjust the balance of spectral reflection density in a white portion of processed materials and improve its whiteness. The surface of the support may be optionally subjected to corona discharge, UV light exposure or flame treatment and further thereon, directly or through a sublayer (i.e., one or more sublayer for making improvements in surface properties of the support, such as adhesion property, antistatic property, dimensional stability, friction resistance, hardness, anti halation and/or other characteristics), are coated component layers of the photographic material relating to the invention. In coating of the photographic material, a thickening agent may be employed to enhance coatability of a coating solution. As a coating method are useful extrusion coating and curtain coating, in which two or more layers are simultaneously coated.

To form photographic images using a photographic material relating to the invention, an image recorded on the negative can optically be formed on a photographic material to be printed. Alternatively, the image is converted to digital information to form the image on a CRT (anode ray tube), and the resulting image can be formed on a photographic material to be printed by projecting or scanning with varying the intensity and/or exposing time of laser light, based on the digital information.

It is preferable to apply the present invention to a photographic material wherein a developing agent is not incorporated in the photographic material. Examples of such a photographic material include color paper, color reversal paper, positive image forming photographic material, photographic material used for display, and photographic material used for color proof. Application to photographic material having a reflective support is specifically preferred.

Commonly known aromatic primary amine developing agents are employed in the invention. Examples thereof include:

CD-1) N,N-diethyl-p-phenylendiamine,
CD-2) 2-amino-5-diethylaminotoluene,
CD-3) 2-amino-5-(N-ethyl-N-laurylamino)toluene,
CD-4) 4-(N-ethyl-N-(β-hydroxyethyl)amino)-aniline,
CD-5) 2-methyl-4-(N-ethyl-N-(β-hydroxyethyl)amino) aniline,
CD-6) 4-amino-3-methyl-N-ethyl-N-(β-methanesulfoneamidoethyl)aniline,
CD-7) 4-amino-3-β-methanesulfoneamidoethyl-N,N-diethyl-aniline
CD-8) N,N-dimethyl-p-phenylenediamine,
CD-9) 4-amino-3-methyl-N-ethyl-N-metoxyethylaniline,
CD-10) 4-amino-3-methyl-N-ethyl-N-(β-ethoxyethyl) aniline,
CD-11) 4-amino-3-methyl-N-ethyl-N-(γ-hydroxypropyl) aniline.

The pH of a color developing solution is optional, but preferably 9.5 to 13.0, and more preferably 9.8 to 12.0 in terms of rapid access. The higher color development temperature enables more rapid access, but the temperature is preferably 35 to 70° C., and more preferably 37 to 60° C. in terms of stability of processing solutions. The color developing time is conventionally 3 min. 30 sec. but the developing time in the invention is preferably not longer than 40 sec., and more preferably not longer than 25 sec. In addition to the developing agents described above, the developing solution is added with commonly known developer component compounds, including an alkaline agent having pH-buffering action, a development inhibiting agent such as chloride ion or benzotriazole, a preservative, and a chelating agent.

In the image forming method according to the invention, photographic materials, after color-developed, may be optionally subjected to bleaching and fixing. The bleaching and fixing may be carried out currently. After fixing, washing is conventionally carried out. Stabilizing may be conducted in place of washing. As a processing apparatus used in the invention is applicable a roller transport type processor in which a photographic material is transported with being nipped by rollers and an endless belt type processor in which a photographic material is transported with being fixed in a belt. Further thereto are also employed a method in which a processing solution supplied to a slit-formed processing bath and a photographic material is transported therethrough, a spraying method, a web processing method by contact with a carrier impregnated with a processing solution and a method by use of viscous processing solution. A large amount of photographic materials are conventionally processed using an automatic processor. In this case, the less replenishing rate is preferred and an environmentally friendly embodiment of processing is replenishment being made in the form of a solid tablet, as described in KOKAI-GIHO (Disclosure of Techniques) 94-16935.

Photographic material used for print, relating to this invention exhibits markedly improved image quality when exposed through negative film having an area of 3 to 7 $cm^2$ per picture element to form images. The negative film may be one having an information recording ability.

EXAMPLES

The present invention will be further described based on examples but are by no means limited to these examples.

Example 1

Silver halide emulsions were prepared according to the procedure described below.

Preparation of Silver Halide Emulsion (B-1)

To 1 liter of an aqueous 2% solution of deionized ossein gelatin (containing 10 ppm calcium), maintained at 40° C. were added solutions (A1) and (B1) for 15 min, while controlling the pAg and pH at 7.3 and 3.0, respectively with vigorously stirring using a stirring mixer described in JP-A No. 62-160128. Subsequently, solutions (A2) and (B2) were added for 90 min with controlling the pAg and pH at 8.0 and 5.5, respectively. Then, solutions (A3) and (B3) were added over 15 min. with controlling the pAg and pH at 8.0 and 5.5, respectively. The pAg was controlled in accordance with the method described in JP-A No. 59-45437 and the pH was controlled using aqueous sulfuric acid or sodium hydroxide solution.

| Solution (A1) | | |
|---|---|---|
| Sodium chloride | 3.42 | g |
| Potassium bromide | 0.03 | g |
| Water to make | 200 | ml |
| **Solution (A2)** | | |
| Sodium chloride | 71.4 | g |
| $K_2[IrCl_6]$ | $3.0 \times 10^{-8}$ | mol/mol AgX |
| $K_2[IrBr_6]$ | $1.0 \times 10^{-8}$ | mol/mol AgX |
| $K_4[Fe(CN)_6]$ | $2.0 \times 10^{-5}$ | mol/mol AgX |
| Potassium bromide | 1.84 | g |
| Water to make | 420 | ml |
| **Solution (A3)** | | |
| Sodium chloride | 30.8 | g |
| Potassium bromide | 0.3 | g |
| Water to make | 180 | ml |

-continued

| Solution (B1) | | |
|---|---|---|
| Silver nitrate | 10 | g |
| Water to make | 200 | ml |
| **Solution (B2)** | | |
| Silver nitrate | 210 | g |
| Water to make | 420 | ml |
| **Solution (B3)** | | |
| Silver nitrate | 90 | g |
| Water to make | 180 | ml |

After completing addition, an aqueous 5% solution containing 30 g of chemically modified gelatin (modification rate of 95%), in which an amino group of gelatin was phenylcarbamoylated, was added to perform desalting in accordance with the method described in JP-A No. 5-72658, and an aqueous gelatin solution was further added thereto to obtain silver halide emulsion (B-1) comprising monodisperse cubic grains having an average grain size (equivalent cubic edge length) of 0.50 μm. The equivalent cubic edge length is an edge length of a cube having the same volume as that of a silver halide grain.

Preparation of Silver Halide Emulsion (B-2)

Monodisperse silver halide cubic grain emulsion (B-2) having an average grain size (equivalent cubic edge length) of 0.50 μm was prepared similarly to the foregoing silver halide emulsion (B-1), provided that the following solution (C1) was added at a constant flow rate over the period from completion of adding 30% of the solution (B3) to completion of adding 50% of the solution (B3).

| Solution (C1) | | |
|---|---|---|
| Potassium iodide | 0.12 | g |
| Water to make | 30.0 | ml |

Preparation of Silver Halide Emulsion (B-3)

Monodisperse silver halide cubic grain emulsion (B-3) having an average grain size (equivalent cubic edge length) of 0.50 μm was prepared similarly to the foregoing silver halide emulsion (B-1), provided that solution (A2) was replaced by the following solution (A2a) and after completion of adding solution (A2a) and solution (B2), the following solution (D1) was added and the pH was adjusted to 9.0 with potassium hydroxide and after 5 min., the pH was again adjusted to 5.5 with sulfuric acid and addition of solution (A3) and solution (B3) was started.

| Solution (A2a) | | |
|---|---|---|
| Sodium chloride | 72.1 | g |
| $K_2[IrCl_6]$ | $3.0 \times 10^{-8}$ | mol/mol AgX |
| $K_2[IrBr_6]$ | $1.0 \times 10^{-8}$ | mol/mol AgX |
| $K_4[Fe(CN)_6]$ | $2.0 \times 10^{-5}$ | mol/mol AgX |
| Potassium bromide | 0.32 | g |
| Water to make | 420 | ml |
| **Solution (D1)** | | |
| Bromide ion releasing agent (BR-1) | $1.3 \times 10^{-2}$ | mol |
| Water to make | 50.0 | ml |

BR-1

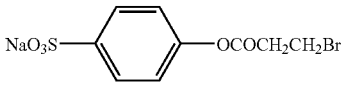

ID-1

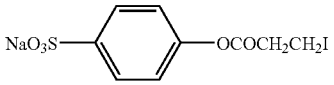

BR-2

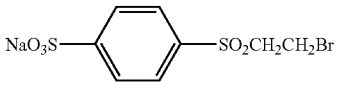

ID-2

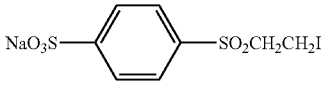

Preparation of Silver Halide Emulsion (B-4)

Monodisperse silver halide cubic grain emulsion (B-4) having an average grain size (equivalent cubic edge length) of 0.50 μm was prepared similarly to the foregoing silver halide emulsion (B-1), provided that solutions (A2) and (A3) were replaced by solutions (A2b) and (A3a), respectively; after completion of addition of solutions (A2b) and (B2), the foregoing solution (D1) was added, the pH was adjusted to 9.0 with aqueous sodium hydroxide solution and after 5 min., the pH was again adjusted to 5.5 with sulfuric acid; then, addition of solutions (A3a) and (B3) was started and at the time of completion of adding 50% of 50% of solution (B3), addition of solutions (A3a) and (B3) was interrupted, the following solution (E1) was added; then, the pH was adjusted to 9.0 with aqueous sodium hydroxide solution and after 5 min., the pH was again adjusted to 5.5; and addition of solutions (A3a) and (B3) was again started.

| | |
|---|---|
| **Solution (A2b)** | |
| Sodium chloride | 72.1 g |
| $K_2[IrCl_6]$ | $3.0 \times 10^{-8}$ mol/mol AgX |
| $K_2[IrBr_6]$ | $1.0 \times 10^{-8}$ mol/mol AgX |
| $K_4[Fe(CN)_6]$ | $2.0 \times 10^{-5}$ mol/mol AgX |
| Potassium bromide | 0.32 g |
| Compound (S-2-5) | $3.0 \times 10^{-5}$ mol/mol AgX |
| Water to make | 420 ml |
| **Solution (A3a)** | |
| Sodium chloride | 30.8 g |
| Potassium bromide | 0.3 g |
| Compound (S-2-5) | $7.0 \times 10^{-6}$ mol/mol AgX |
| Water to make | 180 ml |
| **Solution (E1)** | |
| Iodide ion releasing agent compound (ID-1) | $7.3 \times 10^{-4}$ mol |
| Water to make | 20.0 ml |

Preparation of Silver Halide Emulsion (B-5)

Monodisperse silver halide cubic grain emulsion (B-5) having an average grain size (equivalent cubic edge length) of 0.50 μm was prepared similarly to the foregoing silver halide emulsion (B-4), provided that solution (D1) was replaced by solution (D2) and solution (E1) was replaced by solution (E2).

| | |
|---|---|
| **Solution (D2)** | |
| Bromide ion releasing agent (BR-2) | $2.6 \times 10^{-2}$ mol |
| Water to make | 70.0 ml |
| **Solution (E2)** | |
| Iodide ion releasing agent compound (ID-2) | $7.3 \times 10^{-4}$ mol |
| Water to make | 20.0 ml |

Preparation of Silver Halide Emulsion (B-6)

Monodisperse silver halide cubic grain emulsion (B-6) having an average grain size (equivalent cubic edge length) of 0.50 μm was prepared similarly to the foregoing silver halide emulsion (B-5), provided that the foregoing solution (A3a) was replaced by the following solution (A3b), the solution (D2) was replaced by the following (D3), and after addition of the solution (D3), the pH was adjusted to 10.3, in place of 9.0, with aqueous Sodium hydroxide.

| | |
|---|---|
| **Solution (A3b)** | |
| Sodium chloride | 30.8 g |
| Potassium bromide | 0.3 g |
| Compound (S-2-5) | $1.0 \times 10^{-5}$ mol/mol AgX |
| Water to make | 180 ml |
| **Solution (D3)** | |
| Bromide ion releasing agent (BR-2) | $4.0 \times 10^{-2}$ mol |
| Water to make | 110.0 ml |

Preparation of Silver Halide Emulsion (B-7)

Monodisperse silver halide cubic grain emulsion (B-7) having an average grain size (equivalent cubic edge length) of 0.50 μm was prepared similarly to the foregoing silver halide emulsion (B-6), provided that after completion of addition solutions (A2b) and (B2), the reaction mixture was subjected to ultrafiltration over 15 min. to remove soluble salts and concentrate the volume to 70%, using an apparatus described in JP-A No. 10-33.9923; thereafter, the solution (D3) was added; the pH was adjusted to 10.3 and after 15 min., the pH was again adjusted to 5.5; then, addition of solutions (A3b) and (B3) was started and when addition of solution (B3) reached 30%, addition of solutions (A3b) and (B3) was interrupted and the following solution (E4) was added and then, the pH was adjusted to 10.3 with aqueous sodium hydroxide solution; after 5 min., the pH was again adjusted to 5.5 and addition of solutions (A3b) and (B3) was again started.

| | |
|---|---|
| **Solution (E4)** | |
| Iodide ion releasing agent compound (ID-2) | $1.8 \times 10^{-3}$ mol |
| Water to make | 50.0 ml |

Preparation of Silver Halide Emulsion (B-8)

Monodisperse silver halide cubic grain emulsion (B-8) having an average grain size (equivalent cubic edge length) of 0.50 μm was prepared similarly to the foregoing silver halide emulsion, (B-7), provided that the solution (A2b) was replaced by solution (A2c):

| Solution (A2c) | |
|---|---|
| Sodium chloride | 72.1 g |
| $K_2[IrCl_6]$ | $8.0 \times 10^{-9}$ mol/mol AgX |
| $K_2[IrBr_6]$ | $5.0 \times 10^{-9}$ mol/mol AgX |
| $K_2[IrCl_5(H_2O)]$ | $9.0 \times 10^{-8}$ mol/mol AgX |
| $K_2[IrCl_5$(5-methylthiazole)] | $5.0 \times 10^{-9}$ mol/mol AgX |
| $K_4[Fe(CN)_6]$ | $2.0 \times 10^{-5}$ mol/mol AgX |
| Potassium bromide | 0.32 g |
| Compound (S-2-5) | $3.0 \times 10^{-5}$ mol/mol AgX |
| Water to make | 420 ml |

Preparation of Silver Halide Emulsion (B-9)

Monodisperse silver halide cubic grain emulsion (B-9) having an average grain size (equivalent cubic edge length) of 0.50 μm was prepared similarly to the foregoing silver halide emulsion (B-7), provided that the solution (A2b) was replaced by the following solution (A2d):

| Solution (A2d) | |
|---|---|
| Sodium chloride | 72.1 g |
| $K_2[IrCl_6]$ | $7.0 \times 10^{-9}$ mol/mol AgX |
| $K_2[IrBr_6]$ | $5.0 \times 10^{-9}$ mol/mol AgX |
| $K_2[IrCl_5(H_2O)]$ | $1.0 \times 10^{-7}$ mol/mol AgX |
| $K_2[IrBr_5(H_2O)]$ | $9.0 \times 10^{-9}$ mol/mol AgX |
| $K_2[IrCl_5$(5-methylthiazole)] | $3.0 \times 10^{-9}$ mol/mol AgX |
| $K_4[Fe(CN)_6]$ | $2.0 \times 10^{-5}$ mol/mol AgX |

-continued

| Solution (A2d) | |
|---|---|
| Potassium bromide | 0.32 g |
| Compound (S-2-5) | $3.0 \times 10^{-5}$ mol/mol AgX |
| Water to make | 420 ml |

Preparation of Silver Halide Emulsions (G-1)–(G-9)

Monodisperse silver halide cubic grain emulsions (G-1) to (G-9), each having an average grain size (equivalent cubic edge length) of 0.35 μm were prepared similarly to the foregoing silver halide emulsions (B-1) to (B-9), respectively, provided that the addition time of solution (A1), (A2), (A2a), (A2b), (A2c), (A2d), (A3), (A3a), (A3b), (B1), (B2) or (B3) was optimally varied.

Preparation of Silver Halide Emulsions (R-1)–(R-9)

Monodisperse silver halide cubic grain emulsions (R-1) to (R-9), each having an average grain size (equivalent cubic edge length) of 0.30 μm were prepared similarly to the foregoing silver halide emulsions (B-1) to (B-9), respectively, provided that the addition time of solution (A1), (A2), (A2a), (A2b), (A2c), (A2d), (A3), (A3a), (A3b), (B1), (B2) or (B3) was optimally varied.

Characteristics of silver halide emulsions (B-1) to (B-9), (G-1) to (G-9) and (R-1) to (R-9) are shown in Table 1. In each of the emulsions, at least 99% by number was accounted for by cubic grains and the proportion of (100) face of grains was 98% on teh average; and at least 50% by number of the silver halide grains was accounted for by grains having a chloride content of not less than 90 mol %, an iodide content of from 0 to 2 mol %, and a bromide content of from 0.1 to 10 mol %.

TABLE 1

| Emulsion | Average Grain Size (μm) | CV-1*[1] | Average Chloride Content (mol %) | Average Broide Content (mol %) | Average Iodide Content (mol %) | *2 | *3 | *4 | *5 | *6 | CV-2*[7] (%) | CV-3*[8] (%) | Remark |
|---|---|---|---|---|---|---|---|---|---|---|---|---|---|
| B-1 | 0.50 | 0.07 | 99.0 | 1.0 | 0 | 12 | 9 | 3 | 1 | 0 | 35 | — | Comp. |
| B-2 | 0.50 | 0.07 | 98.96 | 1.0 | 0.04 | 15 | 25 | 11 | 6 | 2 | 36 | 43 | Comp. |
| B-3 | 0.50 | 0.07 | 98.96 | 1.0 | 0.04 | 24 | 52 | 45 | 34 | 26 | 30 | 44 | Comp. |
| B-4 | 0.50 | 0.07 | 98.96 | 1.0 | 0.04 | 55 | 62 | 48 | 43 | 34 | 25 | 30 | Inv. |
| B-5 | 0.50 | 0.07 | 98.26 | 1.7 | 0.04 | 64 | 73 | 66 | 48 | 40 | 22 | 27 | Inv. |
| B-6 | 0.50 | 0.07 | 97.4 | 2.5 | 0.1 | 78 | 78 | 72 | 65 | 55 | 14 | 25 | Inv. |
| B-7 | 0.50 | 0.07 | 97.4 | 2.5 | 0.1 | 96 | 91 | 82 | 75 | 70 | 8 | 16 | Inv. |
| B-8 | 0.50 | 0.07 | 97.4 | 2.5 | 0.1 | 97 | 92 | 84 | 79 | 73 | 8 | 15 | Inv. |
| B-9 | 0.50 | 0.07 | 97.4 | 2.5 | 0.1 | 97 | 92 | 84 | 79 | 73 | 8 | 15 | Inv. |
| G-1 | 0.35 | 0.07 | 99.0 | 1.0 | 0 | 11 | 8 | 4 | 1 | 0 | 37 | — | Comp. |
| G-2 | 0.35 | 0.07 | 98.96 | 1.0 | 0.04 | 15 | 23 | 10 | 4 | 1 | 38 | 45 | Comp. |
| G-3 | 0.35 | 0.07 | 98.96 | 1.0 | 0.04 | 22 | 53 | 46 | 34 | 25 | 32 | 44 | Comp. |
| G-4 | 0.35 | 0.07 | 98.96 | 1.0 | 0.04 | 56 | 61 | 47 | 42 | 35 | 27 | 32 | Inv. |
| G-5 | 0.35 | 0.07 | 98.26 | 1.7 | 0.04 | 65 | 75 | 69 | 47 | 39 | 25 | 26 | Inv. |
| G-6 | 0.35 | 0.07 | 97.4 | 2.5 | 0.1 | 77 | 77 | 72 | 63 | 56 | 13 | 24 | Inv. |
| G-7 | 0.35 | 0.07 | 97.4 | 2.5 | 0.1 | 95 | 91 | 80 | 77 | 71 | 9 | 16 | Inv. |
| G-8 | 0.35 | 0.07 | 97.4 | 2.5 | 0.1 | 95 | 93 | 84 | 78 | 72 | 9 | 14 | Inv. |
| G-9 | 0.35 | 0.07 | 97.4 | 2.5 | 0.1 | 95 | 93 | 84 | 78 | 72 | 9 | 14 | Inv. |
| R-1 | 0.30 | 0.08 | 99.0 | 1.0 | 0 | 12 | 8 | 2 | 0 | 0 | 36 | — | Comp. |
| R-2 | 0.30 | 0.08 | 98.96 | 1.0 | 0.04 | 14 | 23 | 11 | 4 | 2 | 36 | 43 | Comp. |
| R-3 | 0.30 | 0.08 | 98.96 | 1.0 | 0.04 | 22 | 53 | 45 | 35 | 27 | 31 | 43 | Comp. |
| R-4 | 0.30 | 0.08 | 98.96 | 1.0 | 0.04 | 54 | 61 | 48 | 40 | 32 | 25 | 31 | Inv. |

TABLE 1-continued

| Emulsion | Average Grain Size (μm) | CV-1*[1] | Average Chloride Content (mol %) | Average Broide Content (mol %) | Average Iodide Content (mol %) | *2 | *3 | *4 | *5 | *6 | CV-2*[7] (%) | CV-3*[8] (%) | Remark |
|---|---|---|---|---|---|---|---|---|---|---|---|---|---|
| R-5 | 0.30 | 0.08 | 98.26 | 1.7 | 0.04 | 64 | 73 | 68 | 46 | 37 | 23 | 27 | Inv. |
| R-6 | 0.30 | 0.08 | 97.4 | 2.5 | 0.1 | 79 | 76 | 70 | 60 | 54 | 14 | 24 | Inv. |
| R-7 | 0.30 | 0.08 | 97.4 | 2.5 | 0.1 | 96 | 90 | 82 | 78 | 72 | 9 | 17 | Inv. |
| R-8 | 0.30 | 0.08 | 97.4 | 2.5 | 0.1 | 96 | 92 | 85 | 80 | 73 | 9 | 15 | Inv. |
| R-9 | 0.30 | 0.08 | 97.4 | 2.5 | 0.1 | 96 | 92 | 85 | 80 | 73 | 9 | 15 | Inv. |

Table 1 Note
*[1]coefficient of variation in grain size distribution
*2: percentage by number of grains having rounded corners
*3: percentage by number of grains having dislocation lines in the peripheral region of the projection from the direction vertical to a (100) face of the grains
*4: percentage by number of grains having at least 5 dislocation lines in the peripheral region of the projection from the direction vertical to a (100) face of the grains
*5: percentage by number of grains having at least 10 dislocation lines in the peripheral region of the projection from the direction vertical to a (100) face of the grains
*6: percentage by number of grains having at least 20 dislocation lines in the peripheral region of the projection from the direction vertical to a (100) face of the grains
*[7]coefficient of variation in bromide content among grains
*[8]coefficient of variation in iodide content among grains Preparation of Blue-sensitive Emulsions (B-1a) to (B-9a)

To the foregoing silver halide emulsions (B-1) to (B-9), sensitizing dyes (BS-1) and (BS-2) were added at 60° C., a pH of 5.8 and a pAg of 7.5, subsequently, the following compound (1–21) sodium thiosulfate and chloroauric acid were added to perform spectral sensitization and chemical sensitization. Following the addition of chemical sensitizers and when optimally ripened, compounds (S-2-5), (S-2-2), (S-2-3) and (4–6) were successively added to stop ripening. Blue-sensitive silver halide emulsions (B-1a) to (B-9a) were thus obtained.

| | |
|---|---|
| Sodium thiosulfate | $6.5 \times 10^{-6}$ mol/mol AgX |
| Chloroauric acid | $1.9 \times 10^{-5}$ mol/mol AgX |
| Compound S-2-5 | $2.0 \times 10^{-4}$ mol/mol AgX |
| Compound S-2-2 | $2.0 \times 10^{-4}$ mol/mol AgX |
| Compound S-2-3 | $2.0 \times 10^{-4}$ mol/mol AgX |
| Compound (1–21) | $1.5 \times 10^{-5}$ mol/mol AgX |
| Compound (4–6) | $1.5 \times 10^{-5}$ mol/mol AgX |
| Sensitizing dye BS-1 | $5.5 \times 10^{-4}$ mol/mol AgX |
| Sensitizing dye BS-2 | $1.5 \times 10^{-4}$ mol/mol AgX |

BS-1

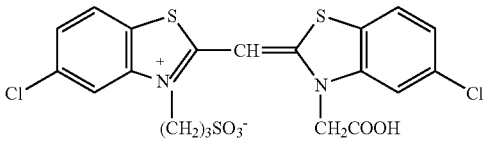

BS-2

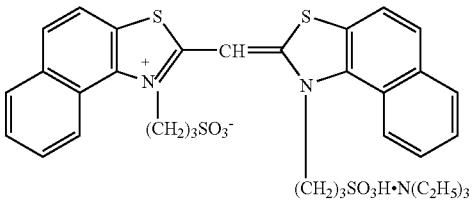

-continued
GS-1
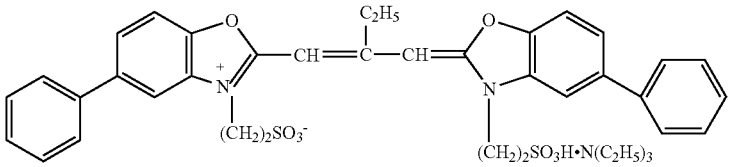
RS-1
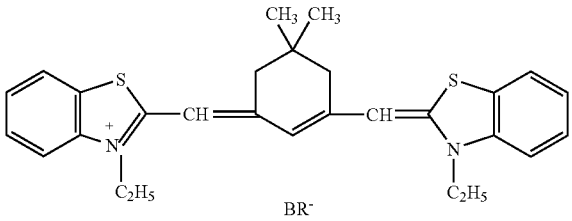
RS-2
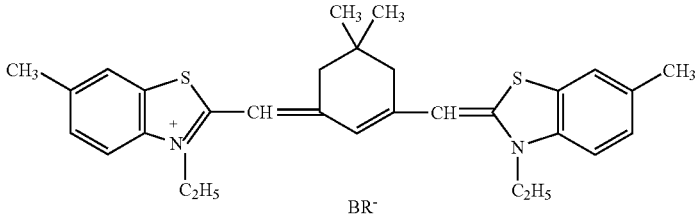
SS-1
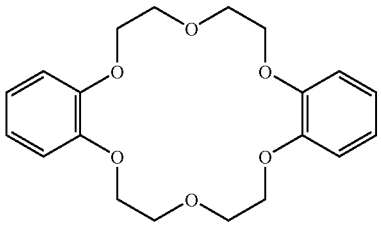
(1–21)
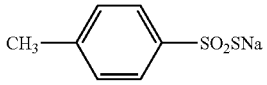
4–6
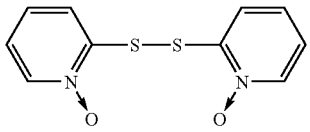

Preparation of Blue-sensitive Emulsion (B-9b)

To the foregoing silver halide-emulsion (B-9), sensitizing dyes (BS-1) and (BS-2) were added at 60° C., a pH of 5.8 and a pAg of 7.5, subsequently, the following compound (1–21), sodium thiosulfate, trifurylphosphine selenide and chloroauric acid were added to perform spectral sensitization and chemical sensitization. Following the addition of chemical sensitizers and when optimally ripened, compounds (S-2-5), (S-2-2), (S-2-3) and (4–6) were successively added to stop ripening. A blue-sensitive silver halide emulsion (B-9b) was thus obtained.

| | |
|---|---|
| Sodium thiosulfate | $3.9 \times 10^{-6}$ mol/mol AgX |
| Trifurylphosphine selenide | $2.6 \times 10^{-6}$ mol/mol AgX |
| Chloroauric acid | $1.9 \times 10^{-5}$ mol/mol AgX |
| Compound S-2-5 | $2.0 \times 10^{-4}$ mol/mol AgX |
| Compound S-2—2 | $2.0 \times 10^{-4}$ mol/mol AgX |
| Compound S-2-3 | $2.0 \times 10^{-4}$ mol/mol AgX |
| Compound (1–21) | $1.5 \times 10^{-5}$ mol/mol AgX |
| Compound (4–6) | $1.5 \times 10^{-5}$ mol/mol AgX |
| Sensitizing dye BS-1 | $5.5 \times 10^{-4}$ mol/mol AgX |
| Sensitizing dye BS-2 | $1.5 \times 10^{-4}$ mol/mol AgX |

Preparation of Green-Sensitive Emulsions (G-1a) to (G-9a)

To each of the foregoing silver halide emulsions (G-1) to (G-9), sensitizing dye (GS-1) was added at 60° C., a pH of 5.8 and a pAg of 7.5 and subsequently, the following compound (1–21), sodium thiosulfate and chloroauric acid were successively added to perform spectral sensitization and chemical sensitization. Following addition of the chemical sensitizers and when optimally ripened, compound (S-2-5) and compound (4–6) were added to stop ripening. Green-sensitive silver halide emulsions (G-1a) to (G-9a) were thus obtained.

| | |
|---|---|
| Sensitizing dye GS-1 | $4.4 \times 10^{-4}$ mol/mol AgX |
| Sodium thiosulfate | $5.5 \times 10^{-6}$ mol/mol AgX |
| Chloroauric acid | $1.5 \times 10^{-5}$ mol/mol AgX |
| Compound S-2-5 | $1.5 \times 10^{-4}$ mol/mol AgX |
| Compound (1-21) | $2.0 \times 10^{-5}$ mol/mol AgX |
| Compound (4-6) | $2.0 \times 10^{-5}$ mol/mol AgX |

Preparation of Green-sensitive Emulsion (G-9b)

To the foregoing silver halide emulsion (G-9), sensitizing dye (GS-1) was added at 60° C., a pH of 5.8 and a pAg of 7.5 and subsequently, the compound (1–21), sodium thiosulfate, trifurylphosphine selenide and chloroauric acid were successively added to perform spectral sensitization and chemical sensitization. Following addition of the chemical sensitizers and when optimally ripened, compound (S-2-5) and compound (4–6) were added to stop ripening. A green-sensitive silver halide emulsion (G-9b) was thus obtained.

| | |
|---|---|
| Sensitizing dye GS-1 | $4.4 \times 10^{-4}$ mol/mol AgX |
| Sodium thiosulfate | $3.3 \times 10^{-6}$ mol/mol AgX |
| Trifurylphosphine selenide | $2.2 \times 10^{-6}$ mol/mol AgX |
| Chloroauric acid | $1.5 \times 10^{-5}$ mol/mol AgX |
| Compound S-2-5 | $1.5 \times 10^{-4}$ mol/mol AgX |
| Compound (1-21) | $2.0 \times 10^{-5}$ mol/mol AgX |
| Compound (4-6) | $2.0 \times 10^{-5}$ mol/mol AgX |

Preparation of Red-sensitive Emulsions (R-1a) to (R-9a)

To each of the foregoing silver halide emulsions (R-1) to (R-9), sensitizing dyes (RS-1) and (RS-2) were added at 60° C., a pH of 5.0 and a pAg of 7.1 and subsequently, the following compound (1–21), sodium thiosulfate and chloroauric acid were added to perform spectral sensitization and chemical sensitization. Following the addition of chemical sensitizers and when optimally ripened, (S-2-5) and compound (4–6) were added to stop ripening. Red-sensitive silver halide emulsions (R-1a) to (R-9a) were thus obtained.

| | |
|---|---|
| Sodium thiosulfate | $1.2 \times 10^{-5}$ mol/mol AgX |
| Chloroauric acid | $1.5 \times 10^{-5}$ mol/mol AgX |
| Compound S-2-5 | $1.2 \times 10^{-4}$ mol/mol AgX |
| Sensitizing dye RS-1 | $1.2 \times 10^{-4}$ mol/mol AgX |
| Sensitizing dye RS-2 | $1.1 \times 10^{-4}$ mol/mol AgX |
| Compound (1-21) | $2.0 \times 10^{-5}$ mol/mol AgX |
| Compound (4-6) | $2.0 \times 10^{-5}$ mol/mol AgX |

Preparation of Red-sensitive Silver Halide Emulsion (R-9b)

To the foregoing silver halide emulsion (R-9), sensitizing dyes (RS-1) and (RS-2) were added at 60° C., a pH of 5.0 and a pAg of 7.1 and subsequently, the compound (1–21), sodium thiosulfate, trifurylphosphine selenide and chloroauric acid were successively added to perform spectral sensitization and chemical sensitization. Following addition of the chemical sensitizers and when optimally ripened, compound (S-2-5) and compound (4–6) were added to stop ripening. A red-sensitive silver halide emulsion (R-9b) was thus obtained.

| | |
|---|---|
| Sodium thiosulfate | $7.2 \times 10^{-6}$ mol/mol AgX |
| Trifurylphosphine selenide | $4.8 \times 10^{-6}$ mol/mol AgX |
| Chloroauric acid | $1.5 \times 10^{-5}$ mol/mol AgX |
| Compound S-2-5 | $1.2 \times 10^{-4}$ mol/mol AgX |
| Sensitizing dye RS-1 | $1.2 \times 10^{-4}$ mol/mol AgX |
| Sensitizing dye RS-2 | $1.1 \times 10^{-4}$ mol/mol AgX |
| Compound (1-21) | $2.0 \times 10^{-5}$ mol/mol AgX |
| Compound (4-6) | $2.0 \times 10^{-5}$ mol/mol AgX |

In the preparation of red-sensitive silver halide emulsions, $2.0 \times 10^{-3}$ mol/mol AgX of compound SS-1 was added after completion of the preparation.

Preparation of Silver Halide Color Photographic Material

Preparation of Sample 101

There was prepared a paper support laminated, on the light-sensitive layer coating side of paper having a weight of 180 g/m$^2$, with high density polyethylene, provided that the light-sensitive layer side was laminated with polyethylene melt containing surface-treated anatase type titanium oxide in an amount of 15% by weight. This reflection support was subjected to corona discharge and provided with a gelatin sublayer, and further thereon, the following component layers, as shown below were provided to prepare a silver halide color photographic material Sample 101.

Coating solutions were prepared according to the following procedure.

1st Layer Coating Solution

To 3.34 g of yellow coupler (Y-1), 10.02 of yellow coupler (Y-2) and 1.67 g of yellow coupler (Y-3), 1.67 g of dye image stabilizer (ST-1), 1.67 g of dye image stabilizer (ST-2), 3.34 g of dye image stabilizer (ST-5), 0.167 g of antistaining agent (HQ-1), 2.67 g of image stabilizer A, 1.34 g of image stabilizer B, 5.0 g of high boiling organic solvent (DBP) and 1.67 g of high boiling solvent (DNP) was added 60 ml of ethyl acetate. Using an ultrasonic homogenizer, the resulting solution was dispersed in 320 ml of an aqueous 7% gelatin solution containing 5 ml of an aqueous 10% surfactant (SU-1) solution to obtain 500 ml of a yellow coupler emulsified dispersion. The obtained dispersion was mixed with the blue-sensitive silver halide emulsion (B-1a) to prepare a 1st layer coating solution.

2nd to 7th Layer Coating Solution

Coating solutions for the 2nd layer to 7th layer were each prepared similarly to the 1st layer coating solution, and the respective coating solutions were coated so as to have a coating amount as shown below.

Hardeners (H-1) and (H-2) were incorporated into the 2nd, 4th and 7th layers. There were also incorporated surfactants, (SU-2) and (SU-3) as a coating aid to adjust surface tension. Further to each layer was a fungicide (F-1) so as to have a total amount of 0.04/$m^2$. The amount of silver halide contained in the respective layers was represented by equivalent converted to silver. Additives used in sample 101 are as follows:

SU-1: Sodium tri-i-propylnaphthalenesulfonate
SU-2: Di(2-ethylhexyl) sulfosuccinate sodium salt
SU-3: 2,2,3,3,4,4,5,5-Octafluoropentyl sulfosuccinate sodium salt
DBP: Dibutyl phthalate
DNP: Dinonyl phthalate
DOP: Dioctyl phthalate
DIDP: Diisodecyl phthalate
H-1: Tetrakis(vinylsulfonylmethyl)methane
H-2: 2,4-Dichloro-6-hydroxy-s-triazine sodium salt
HQ-1: 2,5-di-t-octylhydroquinone
HQ-2: 2,5-di-sec-dodecylhydroquinone
HQ-3: 2,5-di-sec-tetradecylhydroquinone
HQ-4: 2-sec-dodecyl-5-tetradecyhydroquinone
HQ-5: 2,5-di[1,1-dimethyl-4-hexyloxycarbonyl)butyl]-hydroquinone
Image stabilizer A: p-t-Octylphenol
Image stabilizer B: poly(t-butylacrylamide)

Y-1

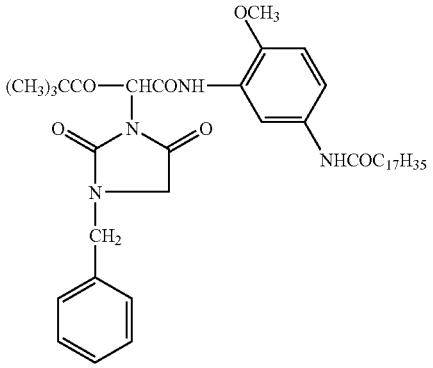

Y-2

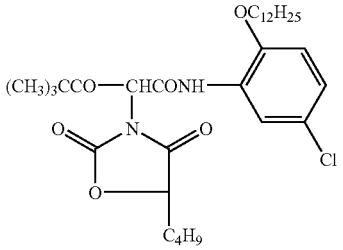

Y-3

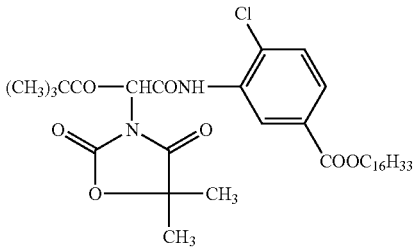

-continued
M-1
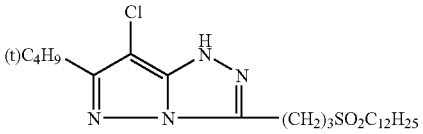
M-2
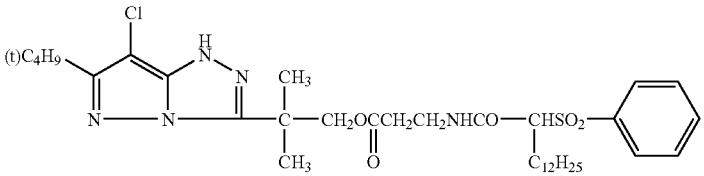
C-1
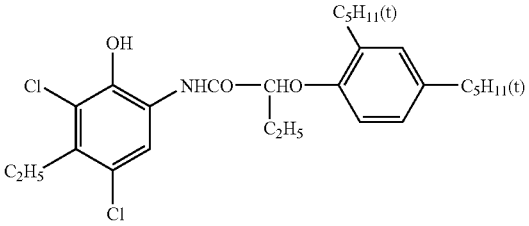
C-2
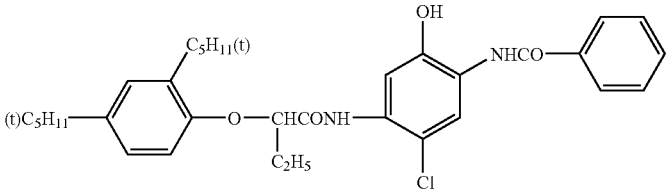
ST-1
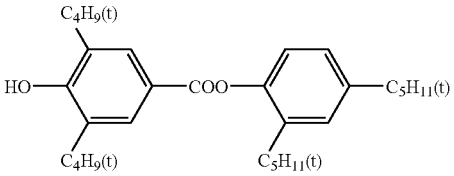
ST-2
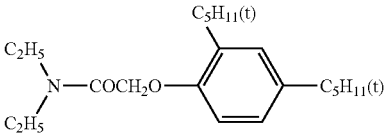
ST-3
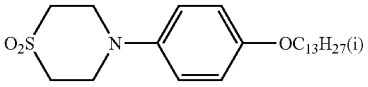

-continued

ST-4

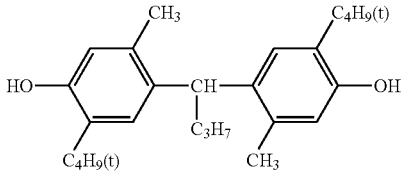

ST-5

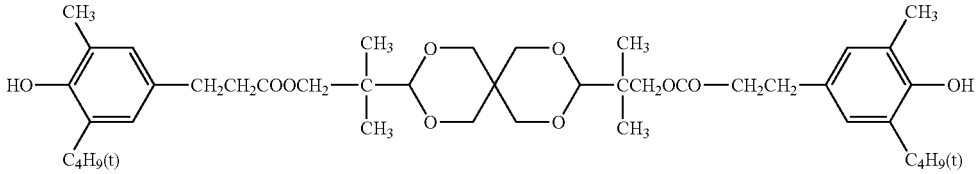

| Layer | Constitution | Amount (g/m$^2$) |
|---|---|---|
| 7th Layer | Gelatin | 0.70 |
| (Protective layer) | DIDP | 0.002 |
| | DBP | 0.002 |
| | Silicon dioxide | 0.003 |
| 6th Layer | Gelatin | 0.40 |
| (UV absorbing layer) | AI-1 | 0.01 |
| | UV absorbent (UV-1) | 0.07 |
| | UV absorbent (UV-2) | 0.12 |
| | Antistaining agent (HQ-5) | 0.02 |
| 5th Layer | Gelatin | 1.00 |
| (Red-sensitive layer) | Red-sensitive emulsion (R-1a) | 0.17 |
| | Cyan coupler (C-1) | 0.22 |
| | Cyan coupler (C-2) | 0.06 |
| | Dye image stabilizer (ST-1) | 0.06 |
| | Antistaining agent (HQ-1) | 0.003 |
| | DBP | 0.10 |
| | DOP | 0.20 |
| 4th Layer | Gelatin | 0.94 |
| (UV absorbing layer) | AI-1 | 0.02 |
| | UV absorbent (UV-1) | 0.17 |
| | UV absorbent (UV-2) | 0.27 |
| | Antistaining agent (HQ-5) | 0.06 |
| 3rd Layer | Gelatin | 1.30 |
| (Green-sensitive layer) | AI-2 | 0.01 |
| | Green-sensitive Emulsion (G-1a) | 0.12 |
| | Magenta coupler (M-1) | 0.05 |
| | Magenta coupler (M-2) | 0.15 |
| | Dye image stabilizer (ST-3) | 0.10 |
| | Dye image stabilizer (ST-4) | 0.02 |
| | DIDP | 0.10 |
| | DBP | 0.10 |
| 2nd layer | Gelatin | 1.20 |
| (Interlayer) | AI-3 | 0.01 |
| | Antistaining agent (HQ-1) | 0.02 |
| | Antistaining agent (HQ-2) | 0.03 |
| | Antistaining agent (HQ-3) | 0.06 |
| | Antistaining agent (HQ-4) | 0.03 |
| | Antistaining agent (HQ-5) | 0.03 |
| | DIDP | 0.04 |
| | DBP | 0.02 |
| 1st layer | Gelatin | 1.10 |
| (Blue-sensitive layer) | Blue-sensitive Emulsion (B-1a) | 0.24 |
| | Yellow coupler (Y-1) | 0.10 |
| | Yellow coupler (Y-2) | 0.30 |
| | Yellow coupler (Y-3) | 0.05 |
| | Dye image stabilizer (ST-1) | 0.05 |
| | Dye image stabilizer (ST-2) | 0.05 |
| | Dye image stabilizer (ST-5) | 0.10 |
| | Antistaining agent (HQ-1) | 0.005 |

-continued

| | | |
|---|---|---|
| | Image stabilizer A | 0.08 |
| | Image stabilizer B | 0.04 |
| | DNP | 0.05 |
| | DBP | 0.15 |
| Support | Polyethylene-laminated paper containing a small amount of colorant | |

Preparation of Samples 102 to 110

Samples 102 to 110 were prepared similarly to Sample 101, except that blue-sensitive silver halide emulsion (B-1a), green-sensitive silver halide emulsion (G-1a) and red-sensitive silver halide emulsion (R-1a) were respectively replaced by silver halide emulsions shown in Table 2.

TABLE 2

| Sample | Silver Halide Emulsion | | | |
|---|---|---|---|---|
| No. | 1st Layer | 3rd Layer | 5th Layer | Remark |
| 101 | B-1a | G-1a | R-1a | Comp. |
| 102 | B-2a | G-2a | R-2a | Comp. |
| 103 | B-3a | G-3a | R-3a | Comp. |
| 104 | B-4a | G-4a | R-4a | Inv. |
| 105 | B-5a | G-5a | R-5a | Inv. |
| 106 | B-6a | G-6a | R-6a | Inv. |
| 107 | B-7a | G-7a | R-7a | Inv. |
| 108 | B-8a | G-8a | R-8a | Inv. |
| 109 | B-9a | G-9a | R-9a | Inv. |
| 110 | B-9b | G-9b | R-9b | Inv. |

Evaluation of Photographic Material

The thus prepared samples 101 to 110 were each evaluated with respect to sensitivity, latent image stability and storage stability in accordance with the following procedure.

Samples were each exposed through an optical wedge to a xenon flash at $10^{-6}$ sec. using a sensitometer for use in high intensity exposure (available from YAMASHITA DENSO Co., Ltd., SX-20 Type). After being allowed to stand for 5 min., exposed samples were processed according to the following color process (which was denoted as process A). Separately samples were also exposed in the same manner as above and after 5 sec., the exposed samples were processed (which was denoted as process B). The thus processed samples were each subjected to densitometry using an optical densitometer (PDA-65 Type, available from Konica Corp.), with respect to yellow reflection image density. Characteristic curves for yellow images, comprising an ordinate (reflection density, D) and an abscissa (exposure, LogE) were prepared and the respective characteristic values were each evaluated as follows.

Sensitivity (or denoted as S) of each sample was determined according to the following equation (1) described below. Sensitivity was represented by a relative value, based on the sensitivity of sample 101 in process A being 100. The minimum density value in the respective characteristic curves was represented as a fog density (or denoted simply as fog) by a relative value, based on the fog density of sample 101 being 100. Further, contrast in process A (denoted as γa) and contrast in process B (denoted as γb) were calculated according to the following equation (2) and variation Δγ was determined according to the following equation (3):

$$\text{Sensitivity } (S)=1/(\text{exposure amount giving a density of fog plus } 1.0) \quad (1)$$

$$\text{Contrast } (\gamma)=1/[\log(\text{exposure amount giving a density of fog plus } 0.8)-\text{Log}(\text{exposure amount giving a density of fog plus } 1.8)] \quad (2)$$

$$\Delta\gamma=(\gamma b/\gamma a)\times 100 \quad (3)$$

A value of Δγ closer to 100 indicates superior latent image stability.

Storage stability was evaluated in the following manner. After aged at 55° C. and 40% RH for 6 days, samples were processed similarly and fog densities of the respective samples were represented by a relative value, based on the fog density of sample 101 which was processed in process A immediately after preparation being 100.

Coating solution stability was evaluated in the following manner. In the preparation of samples 101 to 110, coating was conducted immediately after preparation of coating solutions (coating A) or after prepared coating solution were each allowed to stand at 40° C. for 48 hr (coating B). Sensitivity or fog of a sample obtained in coating B relative to that of coating A was determined, based on the sensitivity or fog in coating A being 100. The sensitivity or fog in coating B is closer to 100, coating solution stability is superior.

Color Process

| Processsing step | Temperature | Time | Repl. Amt.* |
|---|---|---|---|
| Color developing | 38.0 ± 0.3° C. | 45 sec. | 80 ml |
| Bleach-fixing | 35.0 ± 0.5° C. | 45 sec. | 120 ml |
| Stabilizing | 30–34° C. | 60 sec. | 150 ml |
| Drying | 60–80° C. | 30 sec. | |

*Replenishing amount

Color Developer (Tank Solution, Replenisher)

| | Tank soln. | Replenisher |
|---|---|---|
| Water | 800 ml | 800 ml |
| Triethylenediamine | 2 g | 3 g |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N(β-methanesulfonamidoethyl)-3-methyl-4-aminoaniline sulfate | 6.0 g | 10.0 g |
| N,N-diethylhydroxyamine | 6.8 g | 6.0 g |
| Triethanolamine | 10.0 g | 10.0 g |
| Sodium diethyltriaminepentaacetate | 2.0 g | 2.0 g |
| Brightener (4,4'-diaminostilbene-disulfonate derivative) | 2.0 g | 2.5 g |
| Potassium carbonate | 30 g | 30 g |

Water is added to make 1 liter, and the pH of the tank solution and replenisher were respectively adjusted to 10.10 and 10.60 with sulfuric acid or potassium hydroxide.

| Bleach-fixer (Tank solution, Replenisher) | |
|---|---|
| Ammonium ferric diethyltriaminepentaacetate dihydrate | 65 g |
| Diethyltriaminepentaacetic acid | 3 g |
| Ammonium thiosulfate (70% aqueous solution) | 100 ml |
| 2-Amino-5-mercapto-1,3,4-thiadiazole | 2.0 g |
| Ammonium sulfite (40% aqueous solution) | 27.5 ml |
| Water is added to make 1 liter, and the pH is adjusted to 5.0. | |
| **Stabilizer (Tank solution, Replenisher)** | |
| o-Phenylphenol | 1.0 g |
| 5-Chloro-2-methyl-4-isothiazoline-3-one | 0.02 g |
| 2-Methyl-4-isothiazoline-3-one | 0.02 g |
| Diethylene glycol | 1.0 g |
| Brightener (Chinopal SFP) | 2.0 g |
| 1-Hydroxyethylidene-1,1-diphosphonic acid | 1.8 g |
| Bismuth chloride (40% aqueous solution) | 0.65 g |
| Magnesium sulfate heptahydrate | 0.2 g |
| Polyvinyl pyrrolidine (PVP) | 1.0 g |
| Ammonia water (25% aqueous ammonium hydroxide solution) | 2.5 g |
| Trisodium nitrilotriacetate | 1.5 g |
| Water is added to make 1 liter, and the pH is adjusted to 7.5 with sulfurin acid or potassium hydroxide. | |

The thus obtained results are shown in Table 3.

TABLE 3

| Sample No. | Sensitivity | Latent Image Stability | Storage Stability | Coating Solution Stability Sensitivity | Fog | Remark |
|---|---|---|---|---|---|---|
| 101 | 100 | 68 | 125 | 87 | 116 | Comp. |
| 102 | 105 | 70 | 128 | 86 | 117 | Comp. |
| 103 | 113 | 72 | 118 | 90 | 114 | Comp. |
| 104 | 121 | 84 | 106 | 95 | 105 | Inv. |
| 105 | 126 | 86 | 103 | 96 | 105 | Inv. |
| 106 | 128 | 89 | 100 | 96 | 104 | Inv. |
| 107 | 133 | 89 | 97 | 96 | 103 | Inv. |
| 108 | 135 | 95 | 93 | 98 | 101 | Inv. |
| 109 | 136 | 96 | 92 | 98 | 101 | Inv. |
| 110 | 147 | 96 | 92 | 99 | 101 | Inv. |

As is apparent from Table 3, it was proved that samples using the silver halide emulsion relating to this invention resulted in enhanced sensitivity, superior latent image stability, and improved storage stability and coating solution stability, as compared to comparative samples. Further, green-sensitive and red-sensitive silver halide emulsions were similarly evaluated and it was also proved that similarly to the blue-sensitive emulsions, samples using silver halide emulsions relating to this invention led to superior results.

Example 2

Using photographic materials prepared in Example 1, 127 mm wide roll form samples were prepared and evaluated with respect to suitability for digital exposure.

Thus, negative images of processed negative film (Konica Color New CENTURIA 400) were digitized using a film scanner, Q scan 1202JW (available from Konica Corp.) so as to be treatable using computer software, photoshop (Ver. 5.5, available from Adobe Co.). Further to the thus treated images, letters of various sizes and fine lines were added to form image data and operated so as to perform exposure using the following digital scanning exposure apparatus.

As light sources were used a 473 nm laser which was obtained by subjecting YAG solid laser (oscillation wavelength: 946 nm) using semiconductor laser GaAlAs (oscillation wavelength: 808.5 nm) as an exciting light to wavelength conversion by a SHG crystal of $KNbO_3$; a 532 nm laser which was obtained by subjecting $YVO_4$ solid laser (oscillation wavelength: 1064 nm) using semiconductor laser GaAlAs (oscillation wavelength: 808.7 nm) as an exciting light to wavelength conversion by a SHG crystal of KTP; and AlGaInP laser (oscillation wavelength: 670 nm). There was prepared an apparatus, in which three color laser lights were each moved in the direction vertical to the scanning direction, using a polygon mirror so that scanning exposure was successively performed onto color print paper. The exposure amount was controlled by electrical adjustment of the light quantity of the semiconductor lasers. Scanning exposure was conducted at 400 dpi (dpi represents the number of dots per inch or 2.54 cm) and the exposure time per picture element (or pixel) was $5\times10^{-8}$ sec. The exposure amount was adjusted so that the best print images were obtained in the respective samples. After performing scanning exposure, cabinet-size print images were obtained in accordance with the following process.

Color Process

| Processsing step | Temperature | Time | Repl. Amt.* |
|---|---|---|---|
| Color developing | 38.0 ± 0.3° C. | 22 sec. | 81 ml |
| Bleach-fixing | 35.0 ± 0.5° C. | 22 sec. | 54 ml |
| Stabilizing | 30–34° C. | 25 sec. | 150 ml |
| Drying | 60–80° C. | 30 sec. | |

*Replenishing amount

Color Developer (Tank Solution, Replenisher)

| | Tank soln. | Replenisher |
|---|---|---|
| Water | 800 ml | 800 ml |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N(β-methanesulfonamidoethyl)-3-methyl-4-aminoaniline sulfate | 6.0 g | 10.5 g |
| N,N-diethylhydroxyamine | 3.5 g | 6.0 g |
| N,N-bis(2-sulfoethyl)hydroxylamine | 3.5 g | 6.0 g |
| Triethanolamine | 10.0 g | 10.0 g |
| Sodium diethyltriaminepentaacetate | 2.0 g | 2.0 g |
| Brightener (4,4'-diaminostilbene-disulfonate derivative) | 2.0 g | 2.5 g |
| Potassium carbonate | 30 g | 30 g |

Water is added to make 1 liter, and the pH of the tank solution and replenisher were respectively adjusted to 10.1 and 10.6 with sulfuric acid or potassium hydroxide.

Bleach-fixer (Tank Solution, Replenisher)

| | Tank soln. | Replenisher |
|---|---|---|
| Ammonium ferric diethyltriaminepenta-acetate dihydrate | 100 g | 50 g |
| diethyltriaminepentaacetic acid | 3 g | 3 g |
| Ammonium thiosulfate (70% aqueous solution) | 200 ml | 100 ml |
| 2-Amino-5-mercapto-1,3,4-thiadiazole | 2.0 g | 1.0 g |
| Ammonium sulfite (40% aqueous solution) | 50 ml | 25 ml |

Water is added to make 1 liter, and the pH is adjusted to 7.0 with potassium carbonate or glacial acetic acid.

Stabilizer (Tank Solution, Replenisher)

| | |
|---|---|
| o-Phenylphenol | 1.0 g |
| 5-Chloro-2-methyl-4-isothiazoline-3-one | 0.02 g |
| 2-Methyl-4-isothiazoline-3-one | 0.02 g |
| Diethylene glycol | 1.0 g |
| Brightener (Chinopal SFP) | 2.0 g |
| 1-Hydroxyethylidene-1,1-diphosphonic acid | 1.8 g |
| PVP | 1.0 g |
| Ammonia water (25% aqueous ammonium hydroxide solution) | 2.5 g |
| Ethylenediaminetetraacetic acid | 1.0 g |
| Ammonium sulfite (40% aqueous solution) | 10 ml |

Water is added to make 1 liter, and the pH is adjusted to 7.5 with sulfuric acid or potassium hydroxide.

The thus obtained print images were visually evaluated by 20 observers with respect to clearness of fine lines and letters, human skin tone reproduction and color reproduction of green foliage. Further, 100 sheets were exposed for each sample and successively processed. The first and 100th prints were evaluated with respect to print reproducibility, based on the following criteria.

(1) Clearness of Fine Line and Letter

A: neutral fine lines and letters were clearly distinguishable

B: neutral fine lines and letters were clearly distinguishable but outlines becoming slightly blurred C: neutral fine lines and letters were clearly distinguishable but blurred D: neutral fine lines and letters were blurred and undistinguishable.

(2) Human Skin Tone Reproduction

A: bright and natural reproduction;

B: natural reproduction;

C: being slightly muted;

D: being muted.

(3) Color Reproduction of Green Foliage

A: bright and clear reproduction

B: clear reproduction

C: slightly muted reproduction;

D: definitely muted reproduction (4) Print Reproducibility

A: no difference-in prints ere noticed;

B: slight difference in prints were noticed but treated as the same;

C: some differences in prints were noticed and weighed;

D: clear differences in prints were noticed and unacceptable in practice

Evaluation results are shown in Table 4. As is apparent from Table 4, it was proved that samples relating to this invention exhibited superior performance with respect to clearness of fine lines and letters, human skin tone reproduction, color reproduction of green foliage and print reproducibility.

TABLE 4

| Sample No. | Clearness of Fine Line and Letter | Skin Tone Reproduction | Reproduction of Leaves Green | Print Reproducibility | Remark |
|---|---|---|---|---|---|
| 101 | D | D | D | D | Comp. |
| 102 | D | D | D | C | Comp. |
| 103 | C | C | C | C | Comp. |
| 104 | B | B | B | B | Inv. |
| 105 | A | B | B | B | Inv. |
| 106 | A | B | B | A | Inv. |
| 107 | A | B | B | A | Inv. |
| 108 | A | B | A | A | Inv. |
| 109 | A | B | A | A | Inv. |
| 110 | A | B | A | A | Inv. |

Example 3

From negative images of processed negative film (Konica Color New CENTURIA 400), positive images of processed reversal film (Konica Chrome SINBI 1200 High Quality) and photographing image data taken by a digital camera Digital were obtained KD-200Z (available from Konica Corp.), print images were obtained in accordance with the following procedure.

There were prepared roll form samples of 127 mm width, using photographic materials prepared in Example 1. The samples were exposed and processed in Konica digital minilab system QD-21 SUPER (in which print processor QDP-1500 SUPER and processing chemicals ECOJET-HQA-P were employed and processing is conducted in accordance with process CPK-HQA-P). The obtained print samples were evaluated similarly to Example 2. Results thereof are shown in Table 5. Similarly to Example 2, it was proved that samples relating to this invention achieved superior effects.

TABLE 5

| Sample No. | Clearness of Fine Line and Letter | Skin Tone Reproduction | Reproduction of Leaves Green | Print Reproducibility | Remark |
|---|---|---|---|---|---|
| 101 | D | D | D | D | Comp. |
| 102 | D | C | D | D | Comp. |
| 103 | C | C | C | C | Comp. |
| 104 | B | B | B | B | Inv. |
| 105 | A | B | B | B | Inv. |
| 106 | A | B | A | A | Inv. |
| 107 | A | B | A | A | Inv. |
| 108 | A | B | A | A | Inv. |
| 109 | A | B | A | A | Inv. |
| 110 | A | B | A | A | Inv. |

Example 4

Preparation of Silver Halide Emulsion (B-11)

To 2 liter of an aqueous 2% solution of deionized ossein gelatin (containing 10 ppm calcium), maintained at 40° C. were added solutions (A11) and (B11) by the double jet method for 15 min, while controlling the pAg and pH at 7.3 and 3.0, respectively and vigorously stirring by using a stirring mixer described in JP-A No. 62-160128.

Subsequently, solutions (A12) and (B12) were simultaneously added for 90 min with controlling the pAg and pH at 7.8 and 5.5, respectively. Then, solutions (A13) and (B13) were added over 15 min. with controlling the pAg and pH at 7.8 and 5.5, respectively. The pAg was controlled in accordance with the method described in JP-A No. 59-45437 and the pH was controlled using aqueous sulfuric acid or sodium hydroxide solution.

| | |
|---|---|
| Solution (A11) | |
| Sodium chloride | 3.42 g |
| Potassium bromide | 0.03 g |
| Water to make | 200 ml |
| Solution (A12) | |
| Sodium chloride | 71.7 g |
| $K_2[IrCl_6]$ | $3.0 \times 10^{-8}$ mol/mol AgX |
| $K_2[IrBr_6]$ | $1.0 \times 10^{-8}$ mol/mol AgX |
| $K_4[Fe(CN)_6]$ | $2.0 \times 10^{-5}$ mol/mol AgX |
| Potassium bromide | 2.49 g |
| Water to make | 420 ml |
| Solution (A13) | |
| Sodium chloride | 30.8 g |
| Potassium bromide | 0.3 g |
| Water to make | 180 ml |
| Solution (B11) | |
| Silver nitrate | 10 g |
| Water to make | 200 ml |
| Solution (B12) | |
| Silver nitrate | 210 g |
| Water to make | 420 ml |
| Solution (B13) | |
| Silver nitrate | 90 g |
| Water to make | 180 ml |

After completing addition, an aqueous 5% solution containing 30 g of chemically-modified gelatin (modification rate of 95%), in which an amino group of gelatin was phenylcarbamoylated, was added to perform desalting in accordance with the method described in JP-A No. 5-72658, and an aqueous gelatin solution was further added thereto to obtain silver halide emulsion (B-11) comprising monodisperse cubic grains having an average grain size (equivalent cubic edge length) of 0.50 μm.

Preparation of Silver Halide Emulsion (B-12)

Similarly to the foregoing silver halide emulsion (B-11), silver halide emulsion (B-12) comprising monodisperse cubic grains having an average grain size (equivalent cubic edge length) of 0.50 μm was prepared, provided that the following solution (C11) was added over the period of from the time of completing addition of 50% of solution (B13) to the time of completing addition of 60% of solution (B13):

| Solution (C11) | |
|---|---|
| Potassium iodide | 0.12 g |
| Water to make | 30.0 ml |

Preparation of Silver Halide Emulsion (B-13)

Similarly to the foregoing silver halide emulsion (B-11), silver halide emulsion (B-13) comprising monodisperse cubic grains having an average grain size (equivalent cubic edge length) of 0.50 μm was prepared, provided that solution (A12) was replaced by the following solution (A12a); after completion of adding solutions (A12a) and (B2), the following solution (D11) was added; then the pH was adjusted to 9.0 with aqueous potassium hydroxide solution and after 5 min, the pH was again adjusted to 5.5; addition of solutions (A13) and (B13) was started and when 50% of solution (B13) was added, addition of solutions (A13) and (B13) was interrupted and the following solution (E11) was added; then, the pH was adjusted to 10.3 with aqueous potassium hydroxide solution and after 5 min., the pH was again adjusted to 5.5; and addition of solutions (A13) and (B13) was started.

| | |
|---|---|
| Solution (A12a) | |
| Sodium chloride | 72.1 g |
| $K_2[IrCl_6]$ | $3.0 \times 10^{-8}$ mol/mol AgX |
| $K_2[IrBr_6]$ | $1.0 \times 10^{-8}$ mol/mol AgX |
| $K_4[Fe(CN)_6]$ | $2.0 \times 10^{-5}$ mol/mol AgX |
| Potassium bromide | 0.32 g |
| Water to make | 420 ml |
| Solution (D11) | |
| Bromide ion releasing agent (BR-1) | $1.8 \times 10^{-2}$ mol |
| Water to make | 70.0 ml |
| Solution (E11) | |
| Iodide ion releasing agent (ID-1) | $7.3 \times 10^{-4}$ mol |
| Water to make | 20.0 ml |

Preparation of Silver Halide Emulsion (B-14)

Similarly to the foregoing silver halide emulsion (B-11), silver halide emulsion (B-14) comprising monodisperse cubic grains having an average grain size (equivalent cubic edge length) of 0.50 μm was prepared, provided that solutions (A12) and (A13) were replaced by the following solutions (A12b) and (A13a); after completion of adding solutions (A12b) and (B12), the following solution (D12); the pH was adjusted to 9.0 and after 5 min., the pH was again adjusted to 5.5; addition of solutions (A13a) and (B13) was started and when 70% of solution (B13) was added, addition of solutions (A13a) and (B13) was interrupted and the following solution (E12) was added; then, the pH was adjusted to 9.0 with aqueous potassium hydroxide solution and after 5 min., the pH was again adjusted to 5.5; and addition of solutions (A13a) and (B13) was started.

| | |
|---|---|
| Solution (A12b) | |
| Sodium chloride | 72.1 g |
| $K_2[IrCl_6]$ | $3.0 \times 10^{-8}$ mol/mol AgX |
| $K_2[IrBr_6]$ | $1.0 \times 10^{-8}$ mol/mol AgX |
| $K_4[Fe(CN)_6]$ | $2.0 \times 10^{-5}$ mol/mol AgX |
| Potassium bromide | 0.32 g |
| Compound (S-2-5) | $4.0 \times 10^{-5}$ mol/mol AgX |
| Compound (S-1-4) | $2.0 \times 10^{-5}$ mol/mol AgX |
| Water to make | 420 ml |
| Solution (A13a) | |
| Sodium chloride | 30.8 g |
| Potassium bromide | 0.3 g |
| Compound (S-2-5) | $9.0 \times 10^{-6}$ mol/mol AgX |
| Compound (S-1-4) | $2.0 \times 10^{-6}$ mol/mol AgX |
| Water to make | 180 ml |
| Solution (D12) | |
| Bromide ion releasing agent (BR-2) | $1.8 \times 10^{-2}$ mol |
| Water to make | 70.0 ml |
| Solution (E12) | |
| Iodide ion releasing agent (ID-2) | $7.3 \times 10^{-4}$ mol |
| Water to make | 20.0 ml |

Preparation of Silver Halide Emulsion (B-15)

Similarly to the foregoing silver halide emulsion (B-14), silver halide emulsion (B-15) comprising monodisperse cubic grains having an average grain size (equivalent cubic edge length) of 0.50 μm was prepared, provided that after completion of addition solutions (A12b) and (B12), the reaction mixture was subjected to ultrafiltration over 15 min. to remove soluble salts and concentrate the volume to 70%, using an apparatus described in JP-A No. 10-339923; thereafter, the solution (D12) was added; the pH was adjusted to 10.3 and after 5 min., the pH was again adjusted to 5.5; then, addition of solutions (A13a) and (B13) was started and when 70% of solution (B13) was added, addition of solutions (A13a) and (B13) was interrupted and the following solution (E13) was added and then, the pH was adjusted to 10.3 with aqueous sodium hydroxide solution; after 5 min., the pH was again adjusted to 5.5 and addition of solutions. (A13a) and (B13) was again started.

| Solution (E13) | |
|---|---|
| Iodide ion releasing agent (ID-2) | $1.46 \times 10^{-3}$ mol |
| Water to make | 40.0 ml |

Preparation of Silver Halide Emulsion (B-16)

Similarly to the foregoing silver halide emulsion (B-15), silver halide emulsion (B-16) comprising monodisperse cubic grains having an average grain size (equivalent cubic edge length) of 0.50 μm was prepared, provided that solutions (A12b) and (A13a) were replaced by the following solutions (A12c) and (A13b); that after completion of addition solutions (A12c) and (B12), the reaction mixture was subjected to ultrafiltration over 20 min. to remove soluble salts and concentrate the volume to 50%, using an apparatus described in JP-A No. 10-339923; thereafter, the solution (D13) was added; the pH was adjusted to 10.3 and after 5 min., the pH was again adjusted to 5.5; then, addition of solutions (A13b) and (B13) was started and when 70% of solution (B13) was added, addition of solutions (A13b) and (B13) was interrupted and the foreing solution (E13) was added and then, the pH was adjusted to 10.3 with aqueous sodium hydroxide solution; after 5 min., the pH was again adjusted to 5.5 and addition of solutions (A13b) and (B13) was again started.

| Solution (A12c) | |
|---|---|
| Sodium chloride | 72.1 g |
| $K_2[IrCl_6]$ | $3.0 \times 10^{-8}$ mol/mol AgX |
| $K_2[IrBr_6]$ | $1.0 \times 10^{-8}$ mol/mol AgX |
| $K_4[Fe(CN)_6]$ | $2.0 \times 10^{-5}$ mol/mol AgX |
| Potassium bromide | 0.32 g |
| Compound (S-2-5) | $4.5 \times 10^{-5}$ mol/mol AgX |
| Compound (S-1-4) | $4.0 \times 10^{-5}$ mol/mol AgX |
| Water to make | 420 ml |
| Solution (A13b) | |
| Sodium chloride | 30.8 g |
| Potassium bromide | 0.3 g |
| Compound (S-2-5) | $1.0 \times 10^{-5}$ mol/mol AgX |
| Compound (S-1-4) | $5.0 \times 10^{-6}$ mol/mol AgX |
| Water to make | 180 ml |
| Solution (D13) | |
| Bromide ion releasing agent (BR-2) | $2.7 \times 10^{-2}$ mol |
| Water to make | 100.0 ml |

Preparation of Silver Halide Emulsion (B-17)

Similarly to the foregoing silver halide emulsion (B-16), silver halide emulsion (B-17) comprising monodisperse cubic grains having an average grain size (equivalent cubic edge length) of 0.50 μm was prepared, provided that solutions (D13) and (E13) were replaced by the following solutions (D14) and (E14).

| Solution (D14) | |
|---|---|
| Bromide ion releasing agent (BR-2) | $3.7 \times 10^{-2}$ mol |
| Water to make | 150.0 ml |
| Solution (E14) | |
| Iodide ion releasing agent (ID-2) | $2.19 \times 10^{-3}$ mol |
| Water to make | 60.0 ml |

Preparation of Silver Halide Emulsion (B-18)

Similarly to the foregoing silver halide emulsion (B-17), silver halide emulsion (B-18) comprising monodisperse cubic grains having an average grain size (equivalent cubic edge length) of 0.50 μm was prepared, provided that solution (A12c) was replaced by the following solution (A12d).

| Solution (A12d) | |
|---|---|
| Sodium chloride | 72.1 g |
| $K_2[IrCl_6]$ | $8.0 \times 10^{-9}$ mol/mol AgX |
| $K_2[IrBr_6]$ | $5.0 \times 10^{-9}$ mol/mol AgX |
| $K_2[IrCl_5(H_2O)]$ | $9.0 \times 10^{-8}$ mol/mol AgX |
| $K_2[IrCl_5$(5-methylthiazole)] | $5.0 \times 10^{-9}$ mol/mol AgX |
| $K_4[Fe(CN)_6]$ | $2.0 \times 10^{-5}$ mol/mol AgX |
| Potassium bromide | 0.32 g |
| Compound (S-2-5) | $4.5 \times 10^{-5}$ mol/mol AgX |
| Compound (S-1-4) | $4.0 \times 10^{-5}$ mol/mol AgX |
| Water to make | 420 ml |

Preparation of Silver Halide Emulsion (B-19)

Similarly to the foregoing silver halide emulsion (B-17), silver halide emulsion (B-19) comprising monodisperse cubic grains having an average grain size (equivalent cubic edge length) of 0.50 μm was prepared, provided that solution (A12c) was replaced by the following solution (A12e).

| Solution (A12e) | |
|---|---|
| Sodium chloride | 72.1 g |
| $K_2[IrCl_6]$ | $7.0 \times 10^{-9}$ mol/mol AgX |
| $K_2[IrBr_6]$ | $5.0 \times 10^{-9}$ mol/mol AgX |
| $K_2[IrCl_5(H_2O)]$ | $1.0 \times 10^{-7}$ mol/mol AgX |
| $K_2[IrBr_5(H_2O)]$ | $9.0 \times 10^{-9}$ mol/mol AgX |
| $K_2[IrCl_5$(5-methylthiazole)] | $3.0 \times 10^{-9}$ mol/mol AgX |
| $K_4[Fe(CN)_6]$ | $2.0 \times 10^{-5}$ mol/mol AgX |
| Potassium bromide | 0.32 g |
| Compound (S-2-5) | $4.5 \times 10^{-5}$ mol/mol AgX |
| Compound (S-1-4) | $4.0 \times 10^{-5}$ mol/mol AgX |
| Water to make | 420 ml |

Preparation of Silver Halide Emulsions (G-11)–(G-19)

Monodisperse silver halide cubic grain emulsions (G-19) to (G-9), each having an average grain size (equivalent cubic edge length) of 0.35 μm were prepared similarly to the foregoing silver halide emulsions (B-11) to (B-19), respectively, provided that the addition time of solution (A11), (A12), (A12a), (A12b), (A12c), (A12d), (A12e), (A13), (A13a), (A13b), (B11), (B12) or (B13) was optimally varied.

Preparation of Silver Halide Emulsions (R-11)–(R-19)

Monodisperse silver halide cubic grain emulsions (R-11) to (R-19), each having an average grain size (equivalent cubic edge length) of 0.30 μm were prepared similarly to the foregoing silver halide emulsions (B-11) to (B-19), respectively, provided that the addition time of solution (A11), (A12), (A12a), (A12b), (A12c), (A12d), (A12e), (A13), (A13a), (A13b), (B11), (B12), or (B13) was optimally varied.

Characteristics of silver halide emulsions (B-11) to (B-19), (G-11) to (G-19) and (R-11) to (G-19) are shown in Table 6. In each of the emulsions, at least 99% by number of all grains was accounted for by cubic grains and the proportion of (100) face of grains was 98% on the average, and at least 50% by number of the silver halide grains was accounted for by grains having a chloride content of not less than 90 mol %, an iodide content of from 0 to 2 mol %, and a bromide content of from 0.1 to 10 mol %.

Preparation of Green-sensitive Emulsion

Similarly to silver halide emulsions (G-1a) to (G-9a) of Example 1, silver halide emulsions (G-11) to (G-19) were subjected to chemical and spectral sensitization to obtain green-sensitive silver halide emulsions (G-11a) to (G-19a).

Similarly to silver halide emulsion (G-9b) of Example 1, silver halide emulsion (G-19) was subjected to chemical and spectral sensitization to obtain green-sensitive silver halide emulsion (G-19b).

Preparation of Red-sensitive Emulsion

Similarly to silver halide emulsions (R-1a) to (R-9a) of Example 1, silver halide emulsions (R-11) to (R-19) were subjected to chemical and spectral sensitization to obtain red-sensitive silver halide emulsions (R-11a) to (R-19a).

TABLE 6

| Emulsion | Average Grain Size (μm) | CV-1*1 | Average Chloride Content (mol %) | Average Bromide Content (mol %) | Average Iodide Content (mol %) | *2 | *3 | *4 | *5 | *6 | CV-1*7 (%) | CV-2*8 (%) | Remark |
|---|---|---|---|---|---|---|---|---|---|---|---|---|---|
| B-11 | 0.50 | 0.07 | 98.7 | 1.3 | 0 | 8 | 9 | 2 | 1 | 0 | 37 | — | Comp. |
| B-12 | 0.50 | 0.07 | 98.66 | 1.3 | 0.04 | 14 | 22 | 11 | 6 | 1 | 36 | 44 | Comp. |
| B-13 | 0.50 | 0.07 | 98.66 | 1.3 | 0.04 | 50 | 56 | 47 | 38 | 29 | 26 | 32 | Comp. |
| B-14 | 0.50 | 0.07 | 98.66 | 1.3 | 0.04 | 54 | 62 | 48 | 41 | 33 | 25 | 31 | Inv. |
| B-15 | 0.50 | 0.07 | 98.62 | 1.3 | 0.08 | 64 | 73 | 66 | 47 | 39 | 23 | 25 | Inv. |
| B-16 | 0.50 | 0.07 | 98.12 | 1.8 | 0.08 | 75 | 83 | 74 | 67 | 55 | 13 | 23 | Inv. |
| B-17 | 0.50 | 0.07 | 97.62 | 2.3 | 0.08 | 87 | 92 | 85 | 77 | 70 | 8 | 14 | Inv. |
| B-18 | 0.50 | 0.07 | 97.62 | 2.3 | 0.08 | 88 | 92 | 85 | 78 | 70 | 8 | 12 | Inv. |
| B-19 | 0.50 | 0.07 | 97.62 | 2.3 | 0.08 | 88 | 92 | 85 | 78 | 70 | 8 | 12 | Inv. |
| G-11 | 0.35 | 0.08 | 98.7 | 1.3 | 0 | 7 | 10 | 4 | 2 | 0 | 35 | — | Comp. |
| G-12 | 0.35 | 0.08 | 98.66 | 1.3 | 0.04 | 13 | 24 | 13 | 6 | 2 | 35 | 43 | Comp. |
| G-13 | 0.35 | 0.08 | 98.66 | 1.3 | 0.04 | 15 | 54 | 45 | 38 | 31 | 25 | 31 | Comp. |
| G-14 | 0.35 | 0.08 | 98.66 | 1.3 | 0.04 | 52 | 60 | 47 | 40 | 32 | 25 | 30 | Inv. |
| G-15 | 0.35 | 0.08 | 98.62 | 1.3 | 0.08 | 63 | 71 | 63 | 46 | 37 | 23 | 25 | Inv. |
| G-16 | 0.35 | 0.08 | 98.12 | 1.8 | 0.08 | 72 | 81 | 72 | 65 | 55 | 14 | 22 | Inv. |
| G-17 | 0.35 | 0.08 | 97.62 | 2.3 | 0.08 | 84 | 93 | 87 | 78 | 72 | 9 | 15 | Inv. |
| G-18 | 0.35 | 0.08 | 97.62 | 2.3 | 0.08 | 85 | 93 | 87 | 78 | 72 | 9 | 13 | Inv. |
| G-19 | 0.35 | 0.08 | 97.62 | 2.3 | 0.08 | 85 | 93 | 87 | 78 | 72 | 9 | 13 | Inv. |
| R-11 | 0.30 | 0.08 | 98.7 | 1.3 | 0 | 6 | 9 | 3 | 1 | 0 | 37 | — | Comp. |
| R-12 | 0.30 | 0.08 | 98.66 | 1.3 | 0.04 | 12 | 22 | 10 | 5 | 1 | 36 | 44 | Comp. |
| R-13 | 0.30 | 0.08 | 98.66 | 1.3 | 0.04 | 14 | 55 | 47 | 39 | 29 | 26 | 33 | Comp. |
| R-14 | 0.30 | 0.08 | 98.66 | 1.3 | 0.04 | 51 | 62 | 48 | 40 | 32 | 25 | 32 | Inv. |
| R-15 | 0.30 | 0.08 | 98.62 | 1.3 | 0.08 | 63 | 73 | 65 | 47 | 40 | 23 | 26 | Inv. |
| R-16 | 0.30 | 0.08 | 98.12 | 1.8 | 0.08 | 72 | 83 | 73 | 66 | 53 | 13 | 23 | Inv. |
| R-17 | 0.30 | 0.08 | 97.62 | 2.3 | 0.08 | 85 | 91 | 85 | 76 | 70 | 8 | 14 | Inv. |
| R-18 | 0.30 | 0.08 | 97.62 | 2.3 | 0.08 | 85 | 91 | 85 | 76 | 70 | 8 | 12 | Inv. |
| R-19 | 0.30 | 0.08 | 97.62 | 2.3 | 0.08 | 85 | 91 | 85 | 76 | 70 | 8 | 12 | Inv. |

Table 6 Note

*1coefficient of variation in grain size distribution

*2: percentage by number of grains having rounded corners in the peripheral region of the projection from the direction vertical to a (100) face of the grains

*3: percentage by number of grains having dislocation lines in the peripheral region of the projection from the direction vertical to a (100) face of the grains

*4: percentage by number of grains having at least 5 dislocation lines in the peripheral region of the projection from the direction vertical to a (100) face of the grains

*5: percentage by number of grains having at least 10 dislocation lines in the peripheral region of the projection from the direction vertical to a (100) face of the grains

*6: percentage by number of grains having at least 20 dislocation lines in the peripheral region of the projection from the direction vertical to a (100) face of the grains

*7coefficient of variation in bromide content among grains

*8coefficient of variation in iodide content among grains

Preparation of Blue-sensitive Emulsion

Similarly to silver halide emulsions (B-1a) to (B-9a) of Example 1, silver halide emulsions (B-11) to (B-19) were subjected to chemical and spectral sensitization to obtain blue-sensitive silver halide emulsions (B-11a) to (B-19a).

Similarly to silver halide emulsion (B-9b) of Example 1, silver halide emulsion (B-19) was subjected to chemical and spectral sensitization to obtain blue-sensitive silver halide emulsion (B-19b).

Similarly to silver halide emulsion (R-9b) of Example 1, silver halide emulsion (R-19) was subjected to chemical and spectral sensitization to obtain blue-sensitive silver halide emulsion (R-19b).

Similarly to sample 101 of Example 1, samples 201 to 210 were prepared, provided that silver halide emulsion (B-1a) of the 1st layer, silver halide emulsion (G-1a) of the 3rd layer and silver halide emulsion (R-1a) of the 5th layer were respectively replaced, as shown in Table 7. The thus prepared samples were similarly evaluated. Results are shown in Table 8.

TABLE 7

| Sample No. | Silver Halide Emulsion 1st Layer | 3rd Layer | 5th Layer | Remark |
|---|---|---|---|---|
| 201 | B-11a | G-11a | R-11a | Comp. |
| 202 | B-12a | G-12a | R-12a | Comp. |
| 203 | B-13a | G-13a | R-13a | Comp. |
| 204 | B-14a | G-14a | R-14a | Inv. |
| 205 | B-15a | G-15a | R-15a | Inv. |
| 206 | B-16a | G-16a | R-16a | Inv. |
| 207 | B-17a | G-17a | R-17a | Inv. |
| 208 | B-18a | G-18a | R-18a | Inv. |
| 209 | B-19a | G-19a | R-19a | Inv. |
| 210 | B-19b | G-19b | R-19b | Inv. |

TABLE 8

| Sample No. | Sensitivity | Latent Image Stability | Storage Stability | Coating Solution Stability Sensitivity | Fog | Remark |
|---|---|---|---|---|---|---|
| 201 | 100 | 65 | 123 | 80 | 119 | Comp. |
| 202 | 106 | 64 | 126 | 82 | 117 | Comp. |
| 203 | 116 | 70 | 116 | 88 | 113 | Comp. |
| 204 | 122 | 83 | 107 | 94 | 105 | Inv. |
| 205 | 127 | 86 | 103 | 96 | 105 | Inv. |
| 206 | 130 | 88 | 99 | 96 | 104 | Inv. |
| 207 | 133 | 88 | 96 | 97 | 103 | Inv. |
| 208 | 137 | 94 | 92 | 99 | 101 | Inv. |
| 209 | 137 | 95 | 90 | 99 | 101 | Inv. |
| 210 | 149 | 95 | 90 | 99 | 101 | Inv. |

As is apparent from Table 8, it was proved that samples using the silver halide emulsion relating to this invention resulted in enhanced sensitivity, superior latent image stability and improved storage stability, as compared to comparative samples.

Example 5

Samples 201 to 210 of Example 4 are evaluated similarly to Example 2. Results are shown in Table 9. Inventive samples achieved superior effects, as compared to comparative samples.

TABLE 9

| Sample No. | Clearness of Fine Line and Letter | Skin Tone Reproduction | Reproduction of Leaves Green | Print Reproducibility | Remark |
|---|---|---|---|---|---|
| 201 | D | D | D | D | Comp. |
| 202 | D | D | C | D | Comp. |
| 203 | C | C | C | C | Comp. |
| 204 | B | B | B | B | Inv. |
| 205 | A | B | B | B | Inv. |
| 206 | A | B | B | A | Inv. |
| 207 | A | B | B | A | Inv. |
| 208 | A | B | A | A | Inv. |
| 209 | A | B | A | A | Inv. |
| 210 | A | B | A | A | Inv. |

Example 6

Samples 201 to 210 of Example 4 ere evaluated similarly to Example 3. Results are shown in Table 10. Inventive samples achieved superior effects, as compared to comparative samples.

TABLE 10

| Sample No. | Clearness of Fine Line and Letter | Skin Tone Reproduction | Reproduction of Leaves Green | Print reproducibility | Remark |
|---|---|---|---|---|---|
| 201 | D | D | D | D | Comp. |
| 202 | D | C | D | D | Comp. |
| 203 | C | C | C | C | Comp. |
| 204 | B | B | B | B | Inv. |
| 205 | A | B | B | B | Inv. |
| 206 | A | B | B | A | Inv. |
| 207 | A | B | B | A | Inv. |
| 208 | A | B | A | A | Inv. |
| 209 | A | B | A | A | Inv. |
| 210 | A | B | A | A | Inv. |

What is claimed is:

1. A silver halide emulsion comprising silver halide grains, wherein at least 50% by number of the silver halide grains is accounted for by cubic grains having a chloride content of not less than 90 mol %, an iodide content of from 0 to 2 mol % and a bromide content of from 0.1 to 10 mol %, and the cubic grains each containing dislocation lines in the peripheral region of the projection from the direction vertical to a (100) face of the grains and having rounded corners.

2. The silver halide emulsion of claim 1, wherein the cubic grains each have at least 5 dislocation lines in the peripheral region.

3. The silver halide emulsion of claim 1, wherein the cubic grains each have at least 10 dislocation lines in the peripheral region.

4. The silver halide emulsion of claim 1, wherein the bromide content is from 1.5 to 10 mol %.

5. The silver halide emulsion of claim 1, wherein the bromide content is from 2 to 10 mol %.

6. The silver halide emulsion of claim 1, wherein the iodide content is from 0.05 to 2 mol %.

7. The silver halide emulsion of claim 1, wherein the cubic grains each contain a complex of a metal of group 8 of the periodical table of elements and the complex having at least one aqua ligand or at least one organic ligand.

8. The silver halide emulsion of claim 1, wherein the cubic grains have been subjected to selenium sensitization.

9. A silver halide photographic material comprising on a support at least one image forming layer, wherein the image forming layer comprises a silver halide emulsion as claimed in claim 1.

* * * * *